US008442816B2

(12) United States Patent
Shishido

(10) Patent No.: US 8,442,816 B2
(45) Date of Patent: May 14, 2013

(54) MUSIC-PIECE CLASSIFICATION BASED ON SUSTAIN REGIONS

(75) Inventor: Ichiro Shishido, Kanagawa-ken (JP)

(73) Assignee: Victor Company of Japan, Ltd., Yokohama (JP)

( * ) Notice: Subject to any disclaimer, the term of this patent is extended or adjusted under 35 U.S.C. 154(b) by 108 days.

(21) Appl. No.: 12/929,713

(22) Filed: Feb. 10, 2011

(65) Prior Publication Data

US 2011/0132174 A1 Jun. 9, 2011

Related U.S. Application Data

(62) Division of application No. 11/785,008, filed on Apr. 13, 2007, now Pat. No. 7,908,135.

(30) Foreign Application Priority Data

May 31, 2006 (JP) ..... 2006-151166

(51) Int. Cl.
*G10H 2240/075* (2006.01)
*G10L 11/00* (2006.01)
*G10L 19/02* (2006.01)

(52) U.S. Cl.
USPC ..... 704/205; 704/500; 84/616; 84/654

(58) Field of Classification Search ..... 704/205, 704/206, 500, 501; 84/616, 654
See application file for complete search history.

(56) References Cited

U.S. PATENT DOCUMENTS 4,079,650 A 3/1978 Deutsch et al.
4,739,398 A 4/1988 Thomas et al.
5,179,242 A * 1/1993 Usa ..... 84/658
5,712,953 A 1/1998 Langs
5,744,742 A * 4/1998 Lindemann et al. ..... 84/623
5,869,782 A * 2/1999 Shishido et al. ..... 84/609
6,542,869 B1 4/2003 Foote
6,785,645 B2 8/2004 Khalil et al.
6,876,965 B2 4/2005 Mekuria et al.
6,990,443 B1 1/2006 Abe et al.
7,062,442 B2 6/2006 Berg et al.
7,080,253 B2 7/2006 Weare
7,091,409 B2 8/2006 Li et al.
7,179,980 B2 2/2007 Kirkeby et al.
7,214,870 B2 5/2007 Klefenz et al.
7,232,948 B2 6/2007 Zhang
7,250,567 B2 7/2007 Gayama (Continued)

FOREIGN PATENT DOCUMENTS

JP 06-290574 10/1994
JP 2002-278547 9/2002
JP 2004-163767 6/2004
JP 2005-316943 11/2005

*Primary Examiner* — Martin Lerner
(74) *Attorney, Agent, or Firm* — Louis Woo

(57) ABSTRACT

Audio data representative of a music piece is converted into data components in respective different frequency bands for every unit time interval to generate time frequency data pieces assigned to the respective different frequency bands. From the generated time frequency data pieces, detection is made as to each sustain region in which an effective data component in one of the frequency bands continues to occur during a reference time interval or longer. A feature quantity is calculated from at least one of (1) a number of the detected sustain regions and (2) magnitudes of the effective data components in the detected sustain regions. The music piece is classified in response to the calculated feature quantity.

19 Claims, 10 Drawing Sheets

U.S. PATENT DOCUMENTS

| | | | | |
|---|---|---|---|---|
| 7,346,516 | B2 | 3/2008 | Sall et al. | |
| 7,544,881 | B2 * | 6/2009 | Makino et al. | 84/615 |
| 7,574,276 | B2 | 8/2009 | Weare et al. | |
| 7,580,832 | B2 | 8/2009 | Allamanche et al. | |
| 7,653,534 | B2 | 1/2010 | Derboven et al. | |
| 7,745,718 | B2 * | 6/2010 | Makino et al. | 84/615 |
| 7,908,135 | B2 * | 3/2011 | Shishido | 704/205 |
| 2002/0038597 | A1 | 4/2002 | Huopaniemi et al. | |
| 2003/0101050 | A1 | 5/2003 | Khalil et al. | |
| 2004/0167767 | A1 | 8/2004 | Xiong et al. | |
| 2005/0092165 | A1 | 5/2005 | Weare et al. | |
| 2005/0109194 | A1 | 5/2005 | Gayama | |
| 2005/0159942 | A1 | 7/2005 | Singhal | |
| 2005/0163325 | A1 * | 7/2005 | Rodet et al. | 381/56 |
| 2005/0273319 | A1 * | 12/2005 | Dittmar et al. | 704/203 |
| 2006/0059120 | A1 | 3/2006 | Xiong et al. | |
| 2006/0111801 | A1 | 5/2006 | Weare et al. | |
| 2007/0106406 | A1 * | 5/2007 | Makino et al. | 700/94 |
| 2008/0040123 | A1 * | 2/2008 | Shishido | 704/503 |
| 2009/0217806 | A1 * | 9/2009 | Makino et al. | 84/616 |
| 2011/0132173 | A1 * | 6/2011 | Shishido | 84/602 |

* cited by examiner

| IDENTIFIER | AUDIO DATA |
|---|---|
| IDENTIFIER-1 | AUDIO DATA SEGMENT-1 |
| IDENTIFIER-2 | AUDIO DATA SEGMENT-2 |
| ... ... ... | ... ... ... |
| IDENTIFIER-Ns | AUDIO DATA SEGMENT-Ns |

| BLOCK ID NUMBER p | BAND ID NUMBER q | FREQUENCY COMPONENT SUM s |
|---|---|---|
| 1 | 10 | 50.3 |
| 1 | 18 | 35.7 |
| 2 | 16 | 68.4 |
| 3 | 10 | 56.1 |
| 3 | 16 | 62.3 |
| 3 | 21 | 41.5 |
| 4 | 21 | 47.8 |
| ..... | ..... | ..... |
| | | |

| IDENTIFIER | CATEGORY |
|---|---|
| IDENTIFIER-1 | CATEGORY 1 |
| IDENTIFIER-2 | CATEGORY 5 |
| ... ... ... | ... ... ... ... |
| IDENTIFIER-Ns | CATEGORY 2 |

FIG. 14

| BLOCK ID NUMBER | SOUND THICKNESS Rb |
|---|---|
| 0 | 0.4 |
| 1 | 1.8 |
| 2 | 3.7 |
| 3 | 10.5 |
| ..... | ..... |
| Bn | 0.0 |

MUSIC-PIECE CLASSIFICATION BASED ON SUSTAIN REGIONS

This Application is a Divisional of U.S. patent application Ser. No. 11/785,008, filed Apr. 13, 2007, now U.S. Pat. No. 7,908,135, issued Mar. 15, 2011.

BACKGROUND OF THE INVENTION

1. Field of the Invention

This invention generally relates to an apparatus, a method, and a computer program for classifying music pieces represented by audio signals. This invention particularly relates to an apparatus, a method, and a computer program for classifying music pieces according to category such as genre through analyses of audio data representing the music pieces.

2. Description of the Related Art

Japanese patent application publication number 2002-278547 discloses a system composed of a music-piece registering section, a music-piece database, and a music-piece retrieving section. The music-piece registering section registers audio signals representing respective music pieces and ancillary information pieces relating to the respective music pieces in the music-piece database. Each audio signal representing a music piece and an ancillary information piece relating thereto are in a combination within the music-piece database. Each ancillary information piece has an ID, a bibliographic information piece, acoustic feature values (acoustic feature quantities), and impression values about a corresponding music piece. The bibliographic information piece represents the title of the music piece and the name of a singer or a singer group vocalizing in the music piece.

The music-piece registering section in the system of Japanese application 2002-278547 analyzes each audio signal to detect the values (the quantities) of acoustic features of the audio signal. The detected acoustic feature values are registered in the music-piece database. The music-piece registering section converts the detected acoustic feature values into values of a subjective impression about a music piece represented by the audio signal. The impression values are registered in the music-piece database. Examples of the acoustic feature values are the degree of variation in the spectrum between frames of the audio signal, the frequency of generation of a sound represented by the audio signal; the degree of non-periodicity of generation of a sound represented by the audio signal, and the tempo represented by the audio signal. Another example is as follows. The audio signal is divided into components in a plurality of different frequency bands. Rising signal components in the respective frequency bands are detected. The acoustic feature values are calculated from the detected rising signal components.

The music-piece retrieving section in the system of Japanese application 2002-278547 responds to user's request for retrieving a desired music piece. The music-piece retrieving section computes impression values of the desired music piece from subjective-impression-related portions of the user's request. Bibliographic-information-related portions are extracted from the user's request. The computed impression values and the extracted bibliographic-information-related portions of the user's request are combined to form a retrieval key. The music-piece retrieving section searches the music-piece database in response to the retrieval key for ancillary information pieces similar to the retrieval key. Music pieces corresponding to the found ancillary information pieces (the search-result ancillary information pieces) are candidate ones. The music-piece retrieving section selects one from the candidate music pieces according to user's selection or a predetermined selection rule. The search for ancillary information pieces similar to the retrieval key has the following steps. Matching is implemented between the extracted bibliographic-information-related portions of the user's request and the bibliographic information pieces in the music-piece database. Similarities between the computed impression values and the impression values in the music-piece database are calculated. For example, the Euclidean distances therebetween are calculated as similarities. From the ancillary information pieces in the music-piece database, ones are selected on the basis of the matching result and the calculated similarities.

Japanese patent application publication number 2005-316943 discloses the selection of at least one from music pieces. According to Japanese application 2005-316943, a first storage device stores data representing music pieces, and a second storage device stores data representing the actual mean values and unbiased variances of feature parameters of the music pieces. Examples of the feature parameters for each of the music pieces are the number of chords used by the music piece during every minute, the number of different chords used by the music piece, the maximum level of a beat in the music piece, and the maximum level of the amplitude concerning the music piece. The second storage device further contains a default database having data representing reference mean values and unbiased variances of feature parameters for each of different sensitivity words. When a user designates a sensitivity word for music-piece selection, the reference mean values and unbiased variances corresponding to the designated sensitivity word are read out from the default database. The value of conformity (matching) between the readout mean values and unbiased variances and the actual mean values and unbiased variances is calculated for each of the music pieces. Ones corresponding to larger calculated conformity values are selected from the music pieces.

Japanese patent application publication number 2004-163767 discloses a system including a chord analyzer which performs FFT processing of a sound signal to detect a fundamental frequency component and a harmonic frequency component thereof. The chord analyzer decides a chord constitution on the basis of the detected fundamental frequency component. The chord analyzer calculates the intensity ratio of the harmonic frequency component to the fundamental frequency component. From the decided chord constitution and the calculated intensity ratio, a music key information generator detects the music key of a music piece represented by the sound signal. A synchronous environment controller adjusts a lighting unit and an air conditioner into harmony with the detected music key.

One of factors deciding an impression about a music piece is the degree of musical pitch strength defined in auditory sense (hearing sense) and related to the music piece, that is, the degree of hearing-related feeling of a musical interval related to the music piece. For example, a music piece consisting mainly of sounds made by definite pitch instruments (fixed-interval instruments) such as a piano causes a strong sense of pitch strength. On the other hand, a music piece consisting mainly of sounds made by indefinite pitch instruments (interval-less instruments) such as drums causes a weak sense of pitch strength. The degree of a sense of pitch strength closely relates with the genre of a music piece.

Another factor deciding an impression about a music piece is a hearing-related feeling about the thickness of sounds. The thickness of sounds depends on the number of sounds simultaneously generated and the overtone structures of played instruments. The thickness of sounds closely relates with the genre of a music piece. Suppose that there are two music pieces which are the same in melody, tempo, and chord. Even in this case, when the two music pieces are different in the number of sounds simultaneously generated and the overtone structures of played instruments, impressions about the music pieces are different accordingly.

It is unknown to use the degree of a sense of pitch strength and the thickness of sounds as feature quantities regarding each of music pieces.

SUMMARY OF THE INVENTION

It is a first object of this invention to provide a reliable apparatus for classifying music pieces through the use of the degree of a sense of pitch strength or the thickness of sounds as a feature quantity regarding each of the music pieces.

It is a second object of this invention to provide a reliable method of classifying music pieces through the use of the degree of a sense of pitch strength or the thickness of sounds as a feature quantity regarding each of the music pieces.

It is a third object of this invention to provide a reliable computer program for classifying music pieces through the use of the degree of a sense of pitch strength or the thickness of sounds as a feature quantity regarding each of the music pieces.

A first aspect of this invention provides a music-piece classifying apparatus comprising first means for converting audio data representative of a music piece into data components in respective different frequency bands for every unit time interval to generate time frequency data pieces assigned to the respective different frequency bands; second means for detecting, from the time frequency data pieces generated by the first means, each sustain region in which a data component in one of the frequency bands continues to occur during a reference time interval or longer; third means for calculating a feature quantity from at least one of (1) a number of the sustain regions detected by the second means and (2) magnitudes of the data components in the sustain regions; and fourth means for classifying the music piece in response to the feature quantity calculated by the third means.

A second aspect of this invention is based on the first aspect thereof, and provides a music-piece classifying apparatus wherein the third means comprises means for calculating the feature quantity from at least one of (1) an average of the magnitudes of the data components in the sustain-regions, (2) a variance or a standard deviation in the magnitudes of the data components in the sustain regions, (3) differences between the magnitudes of the data components in the sustain regions, (4) a number of ones among the data components in the sustain regions which have values equal to or larger than a prescribed value, and (5) a number of ones among the data components in the sustain regions which have a prescribed variation pattern.

A third aspect of this invention provides a music-piece classifying method comprising the steps of converting audio data representative of a music piece into data components in respective different frequency bands for every unit time interval to generate time frequency data pieces assigned to the respective different frequency bands; detecting, from the generated time frequency data pieces, each sustain region in which a data component in one of the frequency bands continues to occur during a reference time interval or longer; calculating a feature quantity from at least one of (1) a number of the detected sustain regions and (2) magnitudes of the data components in the detected sustain regions; and classifying the music piece in response to the calculated feature quantity.

A fourth aspect of this invention is based on the third aspect thereof, and provides a music-piece classifying method wherein the calculating step comprises calculating the feature quantity from at least one of (1) an average of the magnitudes of the data components in the sustain regions, (2) a variance or a standard deviation in the magnitudes of the data components in the sustain regions, (3) differences between the magnitudes of the data components in the sustain regions, (4) a number of ones among the data components in the sustain regions which have values equal to or larger than a prescribed value, and (5) a number of ones among the data components in the sustain regions which have a prescribed variation pattern.

A fifth aspect of this invention provides a computer program stored in a computer-readable medium. The computer program comprises the steps of converting audio data representative of a music piece into data components in respective different frequency bands for every unit time interval to generate time frequency data pieces assigned to the respective different frequency bands; detecting, from the generated time frequency data pieces, each sustain region in which a data component in one of the frequency bands continues to occur during a reference time interval or longer; calculating a feature quantity from at least one of (1) a number of the detected sustain regions and (2) magnitudes of the data components in the detected sustain regions; and classifying the music piece in response to the calculated feature quantity.

A sixth aspect of this invention is based on the fifth aspect thereof, and provides a computer program wherein the calculating step comprises calculating the feature quantity from at least one of (1) an average of the magnitudes of the data components in the sustain regions, (2) a variance or a standard deviation in the magnitudes of the data components in the sustain regions, (3) differences between the magnitudes of the data components in the sustain regions, (4) a number of ones among the data components in the sustain regions which have values equal to or larger than a prescribed value, and (5) a number of ones among the data components in the sustain regions which have a prescribed variation pattern.

A seventh aspect of this invention provides a music-piece classifying apparatus comprising first means for converting audio data representative of a music piece into data components in respective different frequency bands for every unit time interval; second means for deciding whether or not each of the data components in the respective different frequency bands is effective; third means for detecting, in a time frequency space defined by the different frequency bands and lapse of time, each sustain region where a data component in one of the different frequency bands which is decided to be effective by the second means continues to occur during a reference time interval or longer; fourth means for calculating a feature quantity from at least one of (1) a number of the sustain regions detected by the third means and (2) magnitudes of the effective data components in the sustain regions; and fifth means for classifying the music piece in response to the feature quantity calculated by the fourth means.

This invention has the following advantages. Through an analysis of audio data representing a music piece, it is made possible to extract a feature quantity reflecting the degree of a sense of pitch strength or the thickness of sounds which closely relates with the genre of the music piece and an impression about the music piece. Therefore, the music piece can be accurately classified in response to the extracted feature quantity.

Music pieces can be classified according to newly introduced factor which relates with the degree of a sense of pitch strength or the thickness of sounds. Accordingly, the number of classification-result categories can be increased as compared with prior-art designs.

BRIEF DESCRIPTION OF THE DRAWINGS

FIG. 14 is a diagram showing the format of data in a memory within a sustained pitch region detector in a music-piece classifying apparatus according to a second embodiment of this invention.

DETAILED DESCRIPTION OF THE INVENTION

First Embodiment

Figure 1:
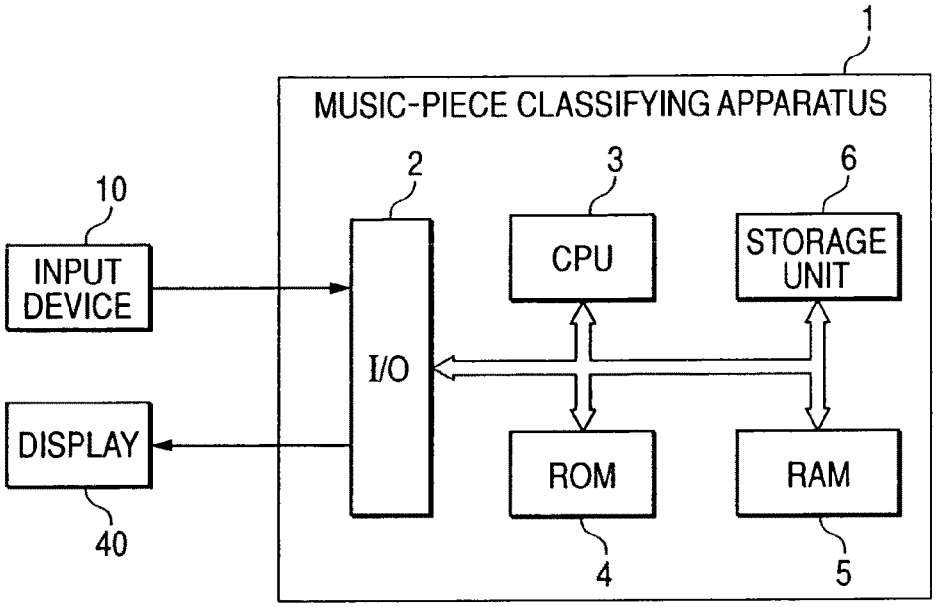
FIG. 1 is a block diagram of a music-piece classifying apparatus according to a first embodiment of this invention.

FIG. 1 shows a music-piece classifying apparatus 1 according to a first embodiment of this invention. The music-piece classifying apparatus 1 includes a computer system having a combination of an input/output port 2, a CPU 3, a ROM 4, a RAM 5, and a storage unit 6. The music-piece classifying apparatus 1 operates in accordance with a control program (a computer program) stored in the ROM 4, the RAM 5, or the storage unit 6. The storage unit 6 includes a large-capacity memory or a combination of a hard disk and a drive therefor. The input/output port 2 is connected with an input device 10 and a display 40.

Figure 2:
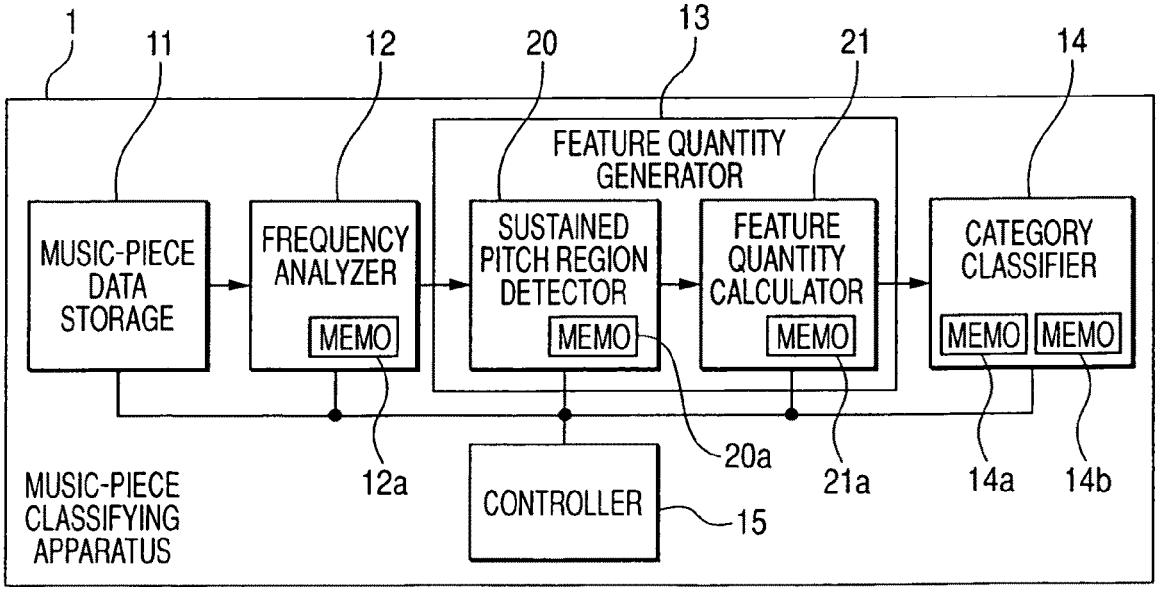
FIG. 2 is an operation flow diagram of the music-piece classifying apparatus in FIG. 1.

With reference to FIG. 2, the music-piece classifying apparatus 1 is designed and programmed to function as a music-piece data storage 11, a frequency analyzer (a time frequency data generator) 12, a feature quantity generator 13, a category classifier 14, and a controller 15. The feature quantity generator 13 includes a sustained pitch region detector 20 and a feature quantity calculator 21. The frequency analyzer 12 is provided with a memory 12*a*. The category classifier 14 is provided with memories 14*a* and 14*b*. The sustained pitch region detector 20 and the feature quantity calculator 21 are provided with memories 20*a* and 21*a*, respectively.

Generally, the music-piece data storage 11 is formed by the storage unit 6. The music-piece data storage 11 contains audio data divided into segments which represent music pieces respectively. Different identifiers are assigned to the music pieces, respectively. The music-piece data storage 11 contains the identifiers in such a manner that the identifiers for the music pieces and the audio data segments representing the music pieces are related with each other. The audio data can be read out from the music-piece data storage 11 on a music-piece by music-piece basis. For example, each time an audio data segment representing a music piece is newly added to the music-piece data storage 11, the newly-added audio data segment is read out from the music-piece data storage 11.

The frequency analyzer 12 is basically formed by the CPU 3. The frequency analyzer 12 processes the audio data read out from the music-piece data storage 11 on a music-piece by music-piece basis. Specifically, for every prescribed time interval (period), the frequency analyzer 12 separates the read-out audio data into components in respective different frequency bands. Thereby, the frequency analyzer 12 generates time frequency data representing the intensities or magnitudes of data components (signal components) in the respective frequency bands. The frequency analyzer 12 stores the time frequency data into the memory 12*a* for each music piece of interest. Generally, the memory 12*a* is formed by the RAM 5 or the storage unit 6.

The sustained pitch region detector 20 in the feature quantity generator 13 is basically formed by the CPU 3. Regarding each music piece of interest, the sustained pitch region detector 20 refers to the time frequency data in the memory 12*a* to detect a sustained pitch region or regions (a sustain region or regions) in which signal components (data components) having intensities or magnitudes equal to or higher than a threshold level continue to occur for at least a predetermined reference time interval. The sustained pitch region detector 20 stores information representative of the detected sustained pitch region or regions into the memory 20*a*. Generally, the memory 20*a* is formed by the RAM 5 or the storage unit 6.

The feature quantity calculator 21 in the feature quantity generator 13 is basically formed by the CPU 3. The feature quantity calculator 21 refers to the sustained-pitch-region information in the memory 20*a*, thereby obtaining the quantities (values) of features of each music piece of interest. The feature quantity calculator 21 stores information representative of the feature quantities (feature values) into the memory 21*a*. Generally, the memory 21*a* is formed by the RAM 5 or the storage unit 6.

The memory 14*a* is preloaded with information (a signal) representing classification rules. In other words, the classification-rule information is previously stored in the memory 14*a*. Generally, the memory 14*a* is formed by the ROM 4, the RAM 5, or the storage unit 6. The category classifier 14 is basically formed by the CPU 3. The category classifier 14 accesses the memory 21*a* to refer to the feature quantities. The category classifier 14 accesses the memory 14*a* to refer to the classification rules. According to the classification rules, the category classifier 14 classifies each music piece of interest into one of predetermined categories in response to the feature quantities of the music piece of interest. The category classifier 14 stores information (signals) representative of the classification results into the memory 14*b*. Generally, the memory 14*b* is formed by the RAM 5 or the storage unit 6. At least a part of the classification results can be notified from the memory 14*b* to the display 40 before being indicated thereon.

The control program for the music-piece classifying apparatus 1 includes a music-piece classifying program. The controller 15 is basically formed by the CPU 3. The controller 15 executes the music-piece classifying program, thereby controlling the music-piece data storage 11, the frequency analyzer 12, the feature quantity generator 13, and the category classifier 14.

The input device 10 can be actuated by a user. User's request or instruction is inputted into the music-piece classifying apparatus 1 when the input device 10 is actuated. The controller 15 can respond to user's request or instruction fed via the input device 10.

Figures 3, 4:
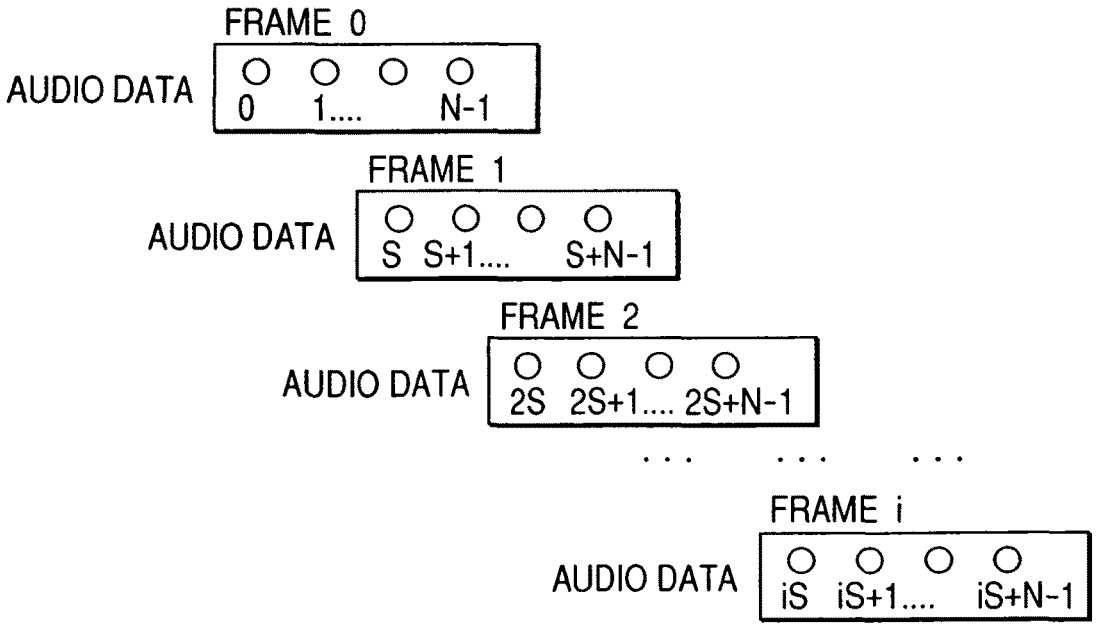
FIG. 3 is a diagram showing the format of data in a music-piece data storage in FIG. 2.
FIG. 4 is a diagram showing the structure of frame data generated by a frequency analyzer in FIG. 2.

The audio data in the music-piece data storage 11 is separated into segments representing the respective music pieces. As shown in FIG. 3, the music-piece data storage 11 stores the identifiers for the respective music pieces and the audio data segments representative of the respective music pieces in such a manner that they are related with each other. The music-piece data storage 11 sequentially outputs the audio data segments to the frequency analyzer 12 in response to a command from the controller 15. The audio data segments may be subjected to decoding and format conversion by the controller 15 before being fed to the frequency analyzer 12. For example, the resultant audio data segments are of a monaural PCM format with a predetermined sampling frequency Fs.

Each of the audio data segments fed to the frequency analyzer 12 has a sequence of samples x[m] where m=0, 1, 2, . . . , L−1, and L indicates the total number of the samples.

The frequency analyzer 12 performs a frequency analysis of each of the audio data segments in response to a command from the controller 15. Specifically, for every prescribed time interval (period), the frequency analyzer 12 separates each audio data segment of interest into components in respective different frequency bands. The frequency analyzer 12 calculates the intensities or magnitudes of signal components (data components) in the respective frequency bands. The frequency analyzer 12 generates time frequency data expressed as a matrix composed of elements representing the calculated signal component intensities (magnitudes) respectively. Preferably, the frequency analysis performed by the frequency analyzer 12 uses known STFT (short-time Fourier transform). Alternatively, the frequency analysis may use wavelet transform or a filter bank.

In more detail, the frequency analyzer 12 divides each audio data segment of interest into frames having a fixed length and defined in a time domain, and processes the audio data segment of interest on a frame-by-frame basis. The length of one frame is denoted by N expressed in sample number. A frame shift length is denoted by S. The frame shift length S corresponds to the prescribed time interval (period). The total number M of frames is given as follows.

$$M = \text{floor}\left(1 + \frac{L-N}{S}\right) \tag{1}$$

The above floor function omits the figures after the decimal point to obtain an integer. The frame length N is equal to or smaller than the total sample number L.

Firstly, the frequency analyzer 12 sets a variable "i" to "0". The variable "i" indicates a current frame order number or a current frame ID number.

Secondly, the frequency analyzer 12 generates i-th frame data y[i][n] where n=0, 1, 2, . . . , N−1, and N indicates the frame length. As shown in FIG. 4, the frequency analyzer 12 extracts N successive samples x[i·S+n] from a sequence of samples constituting the audio data segment of interest. First one in the extracted N successive samples x[i·S+n] is in a place offset from the head of the audio data segment by an interval corresponding to i·S samples, where S indicates the frame shift length. To calculate the i-th frame data y[i][n], the frequency analyzer 12 multiplies the extracted N successive samples x[i·S+n] by a window function w[n] according to the following equation.

$$y[i][n]=w[n]\cdot x[i\cdot S+n](0\leqq n\leqq N-1) \tag{2}$$

Preferably, the window function w[n] uses a Hamming window expressed as follows.

$$w[n] = 0.54 - 0.46\cos\left(\frac{2\pi n}{N-1}\right)\ (0 \le n \le N-1) \tag{3}$$

Alternatively, the window function w[n] may use a rectangular window, a Hanning window, or a Blackman window.

Thirdly, the frequency analyzer 12 performs discrete Fourier transform (DFT) of the i-th frame data y[i][n] and obtains a DFT result a[i][k] according to the following equation.

$$a[i][k] = \sum_{n=0}^{N-1} y[i][n]e^{-j\frac{2\pi kn}{N}}\ (0 \le n \le N-1, 0 \le k \le N-1) \tag{4}$$

Fourthly, the frequency analyzer 12 computes a spectrum b[i][k] from the real part Re{a[i][k]} and the imaginary part Im{a[i][k]} of the DFT result a[i][k] according to one of equations (5) and (6) given below.

$$b[i][k]=(Re\{a[i][k]\})^2+(Im\{a[i][k])\})^2(0\leqq k\leqq N/2-1) \tag{5}$$

$$b[i][k]=\sqrt{(Re\{a[i][k]\})^2+(Im\{a[i][k]\})^2}(0\leqq k\leqq N/2-1) \tag{6}$$

The equation (5) provides a power spectrum. The equation (6) provides an amplitude spectrum.

Fifthly, the frequency analyzer 12 calculates signal components (data components) c[i][q] in different frequency bands "q" from the computed spectrum b[i][k] where "q" is a variable indicating a frequency-band ID number and q=0, 1, 2, . . . , Q−1, and Q indicates the total number of the frequency bands. Generally, the signal components c[i][q] are expressed in intensities or magnitudes (signal intensities or magnitudes).

Sixthly, the frequency analyzer 12 increments the current frame order number "i" by "1". Then, the frequency analyzer 12 checks whether or not the current frame order number "i" is smaller than the total frame number M. When the current frame order number "i" is smaller than the total frame number M, the frequency analyzer 12 repeats the previously-mentioned generation of i-th frame data and the later processing stages. On the other hand, when the current frame order number "i" is equal to or larger than the total frame number M, that is, when all the frames for the audio data segment of interest have been processed, the frequency analyzer 12 terminates operation for the audio data segment of interest.

The details of the calculation of the signal components c[i][q] in the frequency bands "q" are as follows. The frequency analyzer 12 implements the calculation of the signal components c[i][q] in one of the following first and second ways.

The first way uses selected ones or all of the elements of the computed spectrum b[i][k] as the signal components c[i][q] according to the following equation.

$$c[i][q] = b[i][q+\lambda] \quad \left(0 \le q \le Q-1,\ Q \le \frac{N}{2} - \lambda\right) \tag{7}$$

where "λ" indicates a parameter for deciding the lowest frequency among the center frequencies of the bands "q". The parameter "λ" is set to a predetermined integer equal to or larger than "0". The total frequency band number Q is set to a prescribed value equal to or smaller than the value "(N/2)−λ". In the first way, the center frequencies in the bands "q" are spaced at equal intervals so that the amount of necessary calculations is relatively small.

Figure 5:
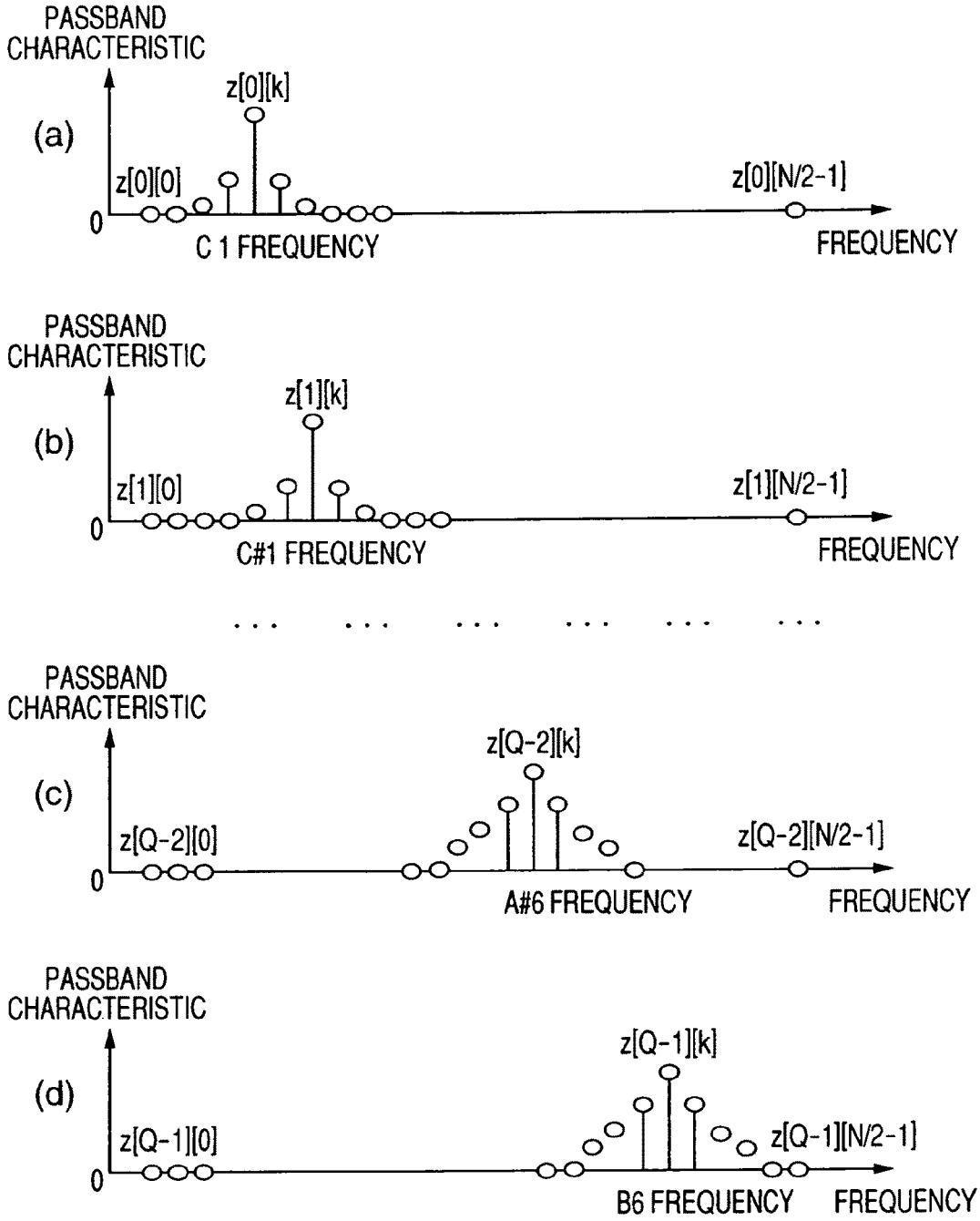
FIG. 5 is a diagram showing an example of the passband characteristics of filters provided by the frequency analyzer in FIG. 2.

The second way calculates the signal components c[i][q] from the computed spectrum b[i][k] according to the following equation.

$$c[i][q] = \sum_{k=0}^{\frac{N}{2}-1} z[q][k] \cdot b[i][k] \tag{8}$$

where z[q][k] denotes a function corresponding to a group of filters having given passband characteristics (frequency responses), for example, those shown in FIG. 5. The center frequencies in the passbands of the filters are chosen to correspond to the frequencies of tones (notes) constituting the equal tempered scale, respectively. Specifically, the center frequencies Fz[q] are set according to the following equation.

$$Fz[q] = Fb \cdot 2^{\frac{q}{12}} \tag{9}$$

where Fb indicates the frequency of the basic or reference note (tone) in the equal tempered scale.

The passband of each of the filters is designed so as to adequately attenuate signal components representing notes neighboring to the note of interest. The center frequencies in the passbands of the filters may be chosen to correspond to the frequencies of tones (notes) constituting the just intonation system, respectively.

In FIG. 5, a C1 tone in the equal tempered scale corresponds to the frequency band "q=0", and subsequent tones spaced at semitone intervals correspond to the frequency band "q=1" and the higher frequency bands respectively. In FIG. 5, z[0][k] denotes the filter for passing a signal component having a frequency corresponding to the C1 tone, and z[1][k] denotes the filter for passing a signal component having a frequency corresponding to the C#1 tone.

The computed spectrum elements b[i][k] are spaced at equal intervals on the frequency axis (frequency domain). On the other hand, the semitone frequency interval between two adjacent tones in the equal tempered scale increases as the frequencies of the two adjacent tones rise. Accordingly, the interval between the center frequencies in the passbands of two adjacent filters increases as the frequencies assigned to the two adjacent filters are higher. In FIG. 5, the interval between the center frequencies in the passbands of the filters z[Q−2][k] and z[Q−1][k] is larger than that between the center frequencies in the passbands of the filters z[0][k] and z[1][k].

The width of the passband of each filter increases as the frequency assigned to the filter is higher. In FIG. 5, the width of the passband of the filter z[Q−1][k] is wider than that of the filter z[0][k].

It should be noted that the frequency analyzer 12 may separate each audio data segment of interest into components in an increased number of different frequency bands by more finely dividing the semitone frequency intervals in the equal tempered scale. Further, frequency bands may be provided in a way including a combination of the previously-mentioned first and second ways. According to an example, frequency bands are divided into a high-frequency band group, an intermediate-frequency band group, and a low-frequency band group, and the previously-mentioned first way is applied to the frequency bands in the high-frequency band group and the low-frequency band group while the previously-mentioned second way is applied to the intermediate-frequency band group.

Figure 6:
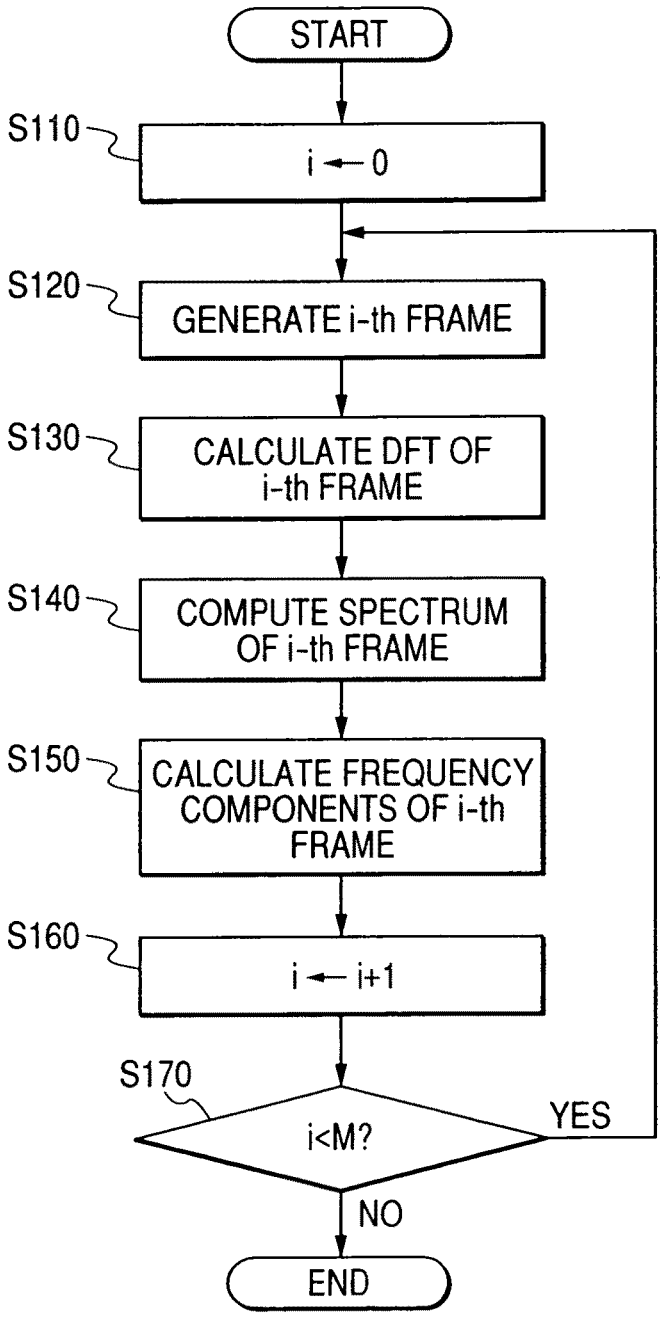
FIG. 6 is a flowchart of a segment of a control program for the music-piece classifying apparatus in FIG. 1 which is designed to implement the frequency analyzer in FIG. 2.

The control program for the music-piece classifying apparatus 1 has a segment (subroutine) designed to implement the frequency analyzer 12. The program segment is executed for each audio data segment of interest, that is, each music piece of interest. FIG. 6 is a flowchart of the program segment.

As shown in FIG. 6, a first step S110 of the program segment sets a variable "i" to "0". The variable "i" indicates a current frame order number or a current frame ID number. After the step S110, the program advances to a step S120.

The step S120 generates i-th frame data y[i][n] where n=0, 1, 2, N−1, and N indicates the frame length. Specifically, the step S120 extracts N successive samples x[i·S+n] from a sequence of samples constituting the audio data segment of interest (see FIG. 4). First one in the extracted N successive samples x[i·S+n] is in a place offset from the head of the audio data segment of interest by an interval corresponding to i·S samples, where S indicates a frame shift length. To calculate the i-th frame data y[i][n], the step S120 multiplies the extracted N successive samples x[i·S+n] by a window function w[n] according to the previously-indicated equation (2).

A step S130 following the step S120 performs discrete Fourier transform (DFT) of the i-th frame data y[i][n] and obtains a DFT result a[i][k] according to the previously-indicated equation (4).

A step S140 subsequent to the step S130 computes a spectrum b[i][k] from the real part Re{a[i][k]} and the imaginary part Im{a[i][k]} of the DFT result a[i][k] according to one of the previously-indicated equations (5) and (6).

A step S150 following the step S140 calculates signal components c[i][q] in different frequency bands "q" from the computed spectrum b[i][k], where q=0, 1, 2, . . . , Q−1, and Q indicates the total number of the frequency bands.

A step S160 subsequent to the step S150 increments the current frame order number "i" by "1".

A step S170 following the step S160 checks whether or not the current frame order number "i" is smaller than the total frame number M. When the current frame order number "i" is smaller than the total frame number M, the program returns from the step S170 to the step S120. When the current frame order number "i" is equal to or larger than the total frame number M, that is, when all the frames for the audio data segment of interest have been processed, the program exits from the step S170 and then the current execution cycle of the program segment ends.

The frequency analyzer 12 stores, into the memory 12*a*, time frequency data representing the calculated signal components c[i][q] in the frames "i" (i=0, 1, 2, M−1) and the frequency bands "q" (q=0, 1, 2, . . . , Q−1). The time frequency data in the memory 12*a* can be used by the sustained pitch region detector 20.

Figures 7, 8:
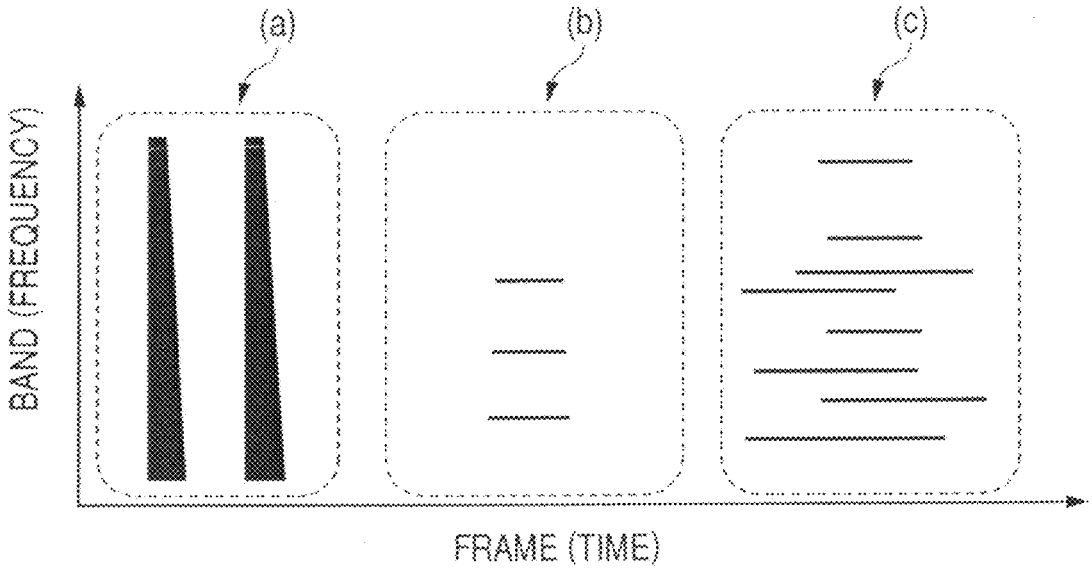
FIG. 7 is a graph showing an example of conditions of calculated signal components represented by time frequency data generated in the frequency analyzer in FIG. 2.
FIG. 8 is a diagram showing the format of data in a memory within a sustained pitch region detector in FIG. 2.

FIG. 7 shows an example of the conditions of the calculated signal components c[i][q] expressed in a graph defined by band (frequency) and frame (time). In FIG. 7, black stripes denote areas filled with signal components having great or appreciable intensities (magnitudes). With reference to FIG. 7, there is a region (a) where only a drum is played in a related music piece. In the region (a), a sound of the drum is generated twice. Accordingly, the region (a) has two sub-regions where appreciable signal components in a wide frequency band exist for only a short time. The region (a) causes a relatively low degree of a sense of pitch strength (pitch existence), that is, a relatively low degree of an interval feeling in the sense of hearing.

In FIG. 7, there is a region (b) where only a few definite pitch instruments (fixed-interval instruments) are played in the related music piece. The region (b) has horizontal black lines since appreciable signal components having fixed frequencies corresponding to a generated fundamental tone and associated harmonic tones are present. The region (b) causes a higher degree of a sense of pitch strength than that by the region (a).

In FIG. 7, there is a region (c) where many definite pitch instruments are played in the related music piece. The region (c) has many horizontal black lines since appreciable signal components having fixed frequencies corresponding to generated fundamental tones and associated harmonic tones are present. The region (c) causes a higher degree of a sense of pitch strength than that by the region (b). In addition, the region (c) causes a greater thickness of sounds than that by the region (b).

The music-piece classifying apparatus 1 generates feature quantities (values) closely relating with the degree of a sense of pitch strength and the thickness of sounds in the sense of hearing. The generated feature quantities are relatively large for the region (c) in FIG. 7, and are relatively small for the region (a) therein.

The sustained pitch region detector 20 reads out, from the memory 12*a*, the time frequency data representing the signal components c[i][q] in the frames "i" (i=0, 1, 2, . . . , M−1) and the frequency bands "q" (q=0, 1, 2, . . . , Q−1). For each music piece of interest, the sustained pitch region detector 20 implements sustained pitch region detection (sustain region detection) in response to the signal components c[i][q] on a block-by-block basis where every block is composed of a predetermined number of successive frames. The total number of frames constituting one block is denoted by Bs. The total number of blocks is denoted by Bn. In the case where the sustained pitch region detector 20 is designed to detect a sustained pitch region or regions throughout every music piece of interest, the total block number Bn is calculated according to the following equation.

$$Bn = \text{floor}\left(\frac{M}{Bs}\right) \tag{10}$$

It should be noted that the sustained pitch region detector 20 may be designed to detect a sustained pitch region or regions in only a portion or portions (a time portion or portions) of every music piece of interest.

The details of the operation of the sustained pitch region detector 20 for a music piece of interest (that is, a current music piece) are as follows. Firstly, the sustained pitch region detector 20 sets a variable "p" to "0". The variable "p" indicates the ID number of a block to be currently processed, that is, a block of interest.

Secondly, the sustained pitch region detector 20 sets the variable "q" to a constant (predetermined value) Q1 providing a lower limit from which a sustained pitch region can extend. The variable "q" indicates the ID number of a frequency band to be currently processed, that is, a frequency band of interest. The number Q1 is equal to or larger than "0" and smaller than the total frequency band number Q.

Thirdly, the sustained pitch region detector 20 sets the variable "i" to a value "p·Bs". The variable "i" indicates the ID number of a frame to be currently processed, that is, a frame of interest. Then, the sustained pitch region detector 20 sets variables "r" and "s" to "0". The variable "r" is used to count effective signal components. The variable "s" is used to indicate the sum of effective signal components.

Fourthly, the sustained pitch region detector 20 checks whether or not a signal component c[i][q] is effective. When the signal component c[i][q] is effective, the sustained pitch region detector 20 increments the effective signal component number "r" by "1" and updates the value "s" by adding the signal component c[i][q] thereto. When the signal component c[i][q] is not effective or when the updating of the value "s" is implemented, the sustained pitch region detector 20 increments the frame ID number "i" by "1". Thus, in this case, "1" is added to the frame ID number "i" regardless of whether or not the signal component c[i][q] is effective.

Fifthly, the sustained pitch region detector 20 decides whether or not the frame ID number "i" is smaller than a value "(p+1)·Bs". When the frame ID number "i" is smaller than the value "(p+1)·Bs", the sustained pitch region detector 20 repeats the check as to whether or not the signal component c[i][q] is effective and the subsequent operation steps. On the other hand, when the frame ID number "i" is not smaller than the value "(p+1)·Bs", the sustained pitch region detector 20 compares the effective signal component number "r" with a constant (predetermined value) V equal to or less than the in-block total frame number Bs. This comparison is to decide whether or not there is a sustained pitch region defined by the effective signal components. When the effective signal component number "r" is equal to or larger than the constant V, it is decided that there is a sustained pitch region. On the other hand, when the effective signal component number "r" is less than the constant V, it is decided that there is no sustained pitch region.

In the case where the constant V is preset to the in-block total frame number Bs, a sustained pitch region is concluded to be present only when Bs effective signal components are successively detected. Generally, a note required to be generated for a certain time length tends to be accompanied with a vibrato (small frequency fluctuation). Such a vibrato causes effective signal components to be detected non-successively (intermittently) rather than successively. Accordingly, it is preferable to preset the constant V to a value between 80% of the in-block total frame number Bs and 90% thereof.

When the effective signal component number "r" is equal to or larger than the constant V or when it is decided that there is a sustained pitch region, the sustained pitch region detector 20 stores, into the memory 20*a*, information pieces (signals)

representing the block ID number "p", the frequency-band ID number "q", and the effective signal component sum "s" as an indication of a currently-detected sustained pitch region. Subsequently, the sustained pitch region detector 20 increments the frequency-band ID number "q" by "1".

On the other hand, when the effective signal component number "r" is less than the constant V or when it is decided that there is no sustained pitch region, the sustained pitch region detector 20 immediately increments the frequency-band ID number "q" by "1".

After incrementing the frequency-band ID number "q" by "1", the sustained pitch region detector 20 compares the frequency-band ID number "q" with a constant (predetermined value) Q2 providing an upper limit to which a sustained pitch region can extend. The number Q2 is equal to or larger than the number Q1. The number Q2 is equal to or less than the total frequency band number Q. When the frequency-band ID number "q" is equal to or less than the constant Q2, the sustained pitch region detector 20 repeats setting the frame ID number "i" to the value "p·Bs" and the subsequent operation steps. On the other hand, when the frequency-band ID number "q" is larger than the constant Q2, the sustained pitch region detector 20 increments the block ID number "p" by "1".

Thereafter, the sustained pitch region detector 20 decides whether or not the block ID number "p" is less than the total block number Bn. When the block ID number "p" is less than the total block number Bn, the sustained pitch region detector 20 repeats setting the frequency-band ID number "q" to the constant Q1 and the subsequent operation steps. On the other hand, when the block ID number "p" is not less than the total block number Bn, the sustained pitch region detector 20 terminates the sustained pitch region detection for the current music piece.

As a result of the above-mentioned sustained pitch region detection, information pieces representing a detected sustained pitch region or regions are stored in the memory 20*a*. The sustained pitch region detector 20 arranges the stored information pieces in a format such as shown in FIG. 8.

Figure 9:
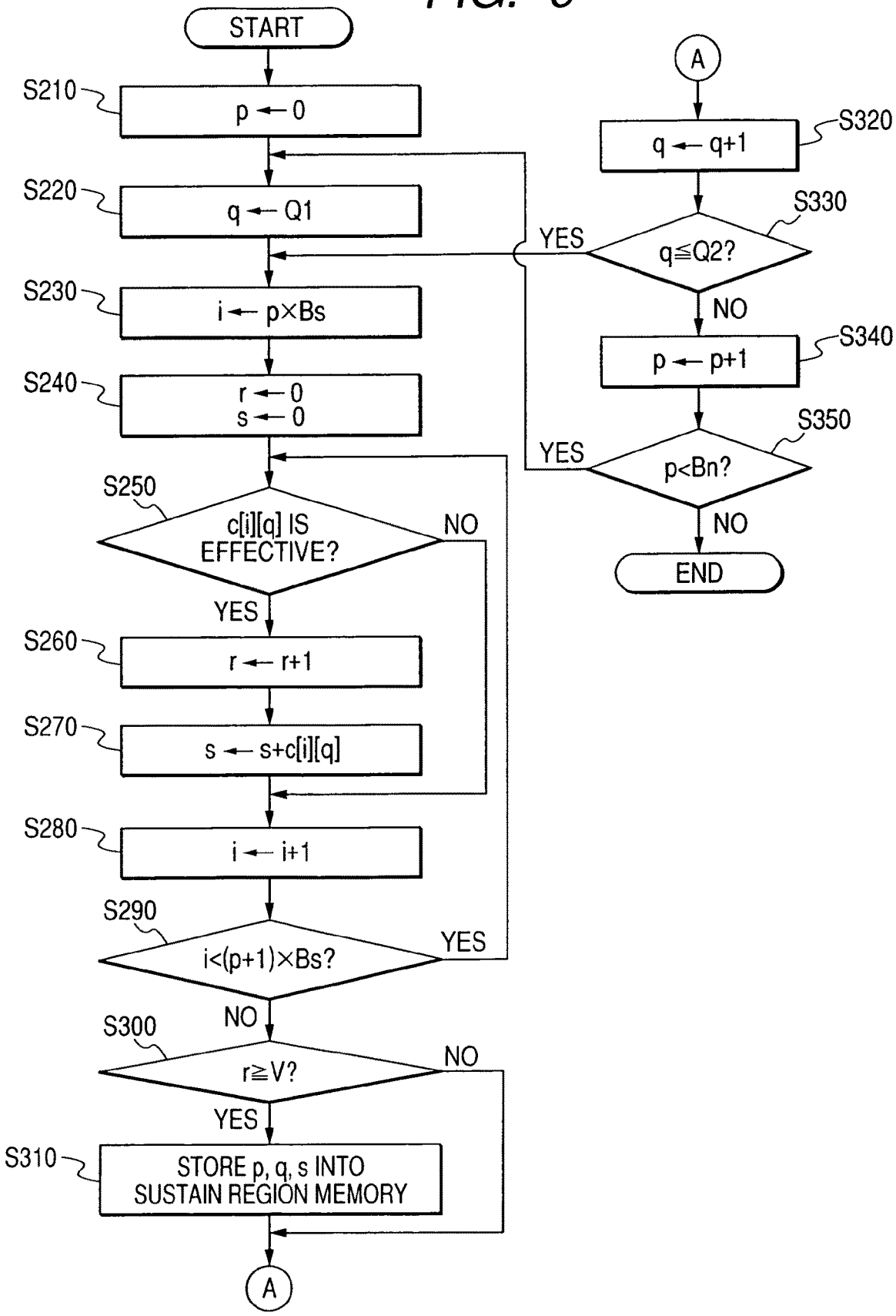
FIG. 9 is a flowchart of a segment of the control program for the music-piece classifying apparatus in FIG. 1 which is designed to implement the sustained pitch region detector in FIG. 2.

The control program for the music-piece classifying apparatus 1 has a segment (subroutine) designed to implement the sustained pitch region detector 20. The program segment is executed for each audio data segment of interest, that is, each music piece of interest. FIG. 9 is a flowchart of the program segment.

As shown in FIG. 9, a first step S210 of the program segment sets the variable "p" to "0". The variable "p" indicates the ID number of a block to be currently processed, that is, a block of interest. After the step S210, the program advances to a step S220.

The step S220 sets the frequency-band ID number "q" to the constant (predetermined value) Q1 providing the lower limit from which a sustained pitch region can extend. After the step S220, the program advances to a step S230.

The step S230 sets the frame ID number "i" to the value "p·Bs", where Bs denotes the total number of frames constituting one block.

A step S240 following the step S230 sets the variables "r" and "s" to "0". The variable "r" is used to count effective signal components. The variable "s" is used to indicate the sum of effective signal components. After the step S240, the program advances to a step S250.

The step S250 checks whether or not the signal component c[i][q] is effective. When the signal component c[i][q] is effective, the program advances from the step S250 to a step S260. Otherwise, the program advances from the step S250 to a step S280.

The step S260 increments the effective signal component number "r" by "1". A step S270 following the step S270 updates the value "s" by adding the signal component c[i][q] thereto. After the step S270, the program advances to the step S280.

The step S280 increments the frame ID number "i" by "1". After the step S280, the program advances to a step S290.

The step S290 decides whether or not the frame ID number "i" is smaller than the value "(p+1)·Bs". When the frame ID number "i" is smaller than the value "(p+1)·Bs", the program returns from the step S290 to the step S250. Otherwise, the program advances from the step S290 to a step S300.

The step S300 compares the effective signal component number "r" with the constant (predetermined value) V equal to or less than the in-block total frame number Bs. This comparison is to decide whether or not there is a sustained pitch region defined by the effective signal components. When the effective signal component number "r" is equal to or larger than the constant V or when it is decided that there is a sustained pitch region, the program advances from the step S300 to a step S310. On the other hand, when the effective signal component number "r" is less than the constant V or when it is decided that there is no sustained pitch region, the program advances from the step S300 to a step S320.

The step S310 stores, into the RAM 5 (the memory 20*a*), the information pieces or the signals representing the block ID number "p", the frequency-band ID number "q", and the effective signal component sum "s" as an indication of a currently-detected sustained pitch region. After the step S310, the program advances to the step S320.

The step S320 increments the frequency-band ID number "q" by "1". After the step S320, the program advances to a step S330.

The step S330 compares the frequency-band ID number "q" with the constant (predetermined value) Q2 providing the upper limit to which a sustained pitch region can extend. When the frequency-band ID number "q" is equal to or less than the constant Q2, the program returns from the step S330 to the step S230. On the other hand, when the frequency-band ID number "q" is larger than the constant Q2, the program advances from the step S330 to a step S340.

The step S340 increments the block ID number "p" by "1". After the step S340, the program advances to a step S350.

The step S350 decides whether or not the block ID number "p" is less than the total block number Bn. When the block ID number "p" is less than the total block number Bn, the program returns from the step S350 to the step S220. Otherwise, the program exits from the step S350 and then the current execution cycle of the program segment ends.

As previously mentioned, the sustained pitch region detector 20 checks whether or not the signal component c[i][q] is effective. The sustained pitch region detector 20 implements this check in one of first to seventh ways explained below.

According to the first way, the sustained pitch region detector 20 compares the signal component c[i][q] with a threshold value a[q]. Specifically, the sustained pitch region detector 20 decides whether or not the following relation (11) is satisfied.

$$c[i][q] \geqq \alpha[q] \tag{11}$$

When the signal component c[i][q] is equal to or larger than the threshold value α[q], the sustained pitch region detector 20 concludes the signal component c[i][q] to be effective. Otherwise, the sustained pitch region detector 20 concludes the signal component c[i][q] to be not effective. For example, the threshold value α[q] is equal to a preset constant. Alternatively, the threshold value α[q] may be determined according to the following equation.

$$\alpha[q] = \frac{\beta}{M}\sum_{i=0}^{M-1} c[i][q] \tag{12}$$

where "β" denotes a preset constant. In this case, the threshold value α[q] is equal to the average of the signal components in the related frequency band.

According to the second way, the sustained pitch region detector 20 decides whether or not both the following relations (13) are satisfied.

$$c[i][q]>Xf(c[i][q-G1],c[i][q-(G1+1)],\ldots,c[i][q-G2])$$

$$c[i][q]>Xf(c[i][q+G1],c[i][q+(G1+1)],\ldots,c[i][q+G2]) \tag{13}$$

where Xf denotes a function taking (G2−G1+1) parameters or arguments, and G1 and G2 denote integers meeting conditions as 0<G1≦G2. In the case where the frequency analyzer 12 tunes the frequency bands to the respective tones (semitones) in the musical scale, it is preferable to set each of the integers G1 and G2 to "1". When both the above relations (13) are satisfied, the sustained pitch region detector 20 concludes the signal component c[i][q] to be effective. Otherwise, the sustained pitch region detector 20 concludes the signal component c[i][q] to be not effective. Therefore, only in the case where the signal component c[i][q] is larger than both the value resulting from substituting the i-th-frame signal components in the frequency bands "q+G1, q+(G1+1), q+G2" higher in frequency than and near the present frequency band "q" into the function Xf and the value resulting from substituting the i-th-frame signal components in the frequency bands "q-G1, q−(G1+1), . . . , q−G2" lower in frequency than and near the present frequency band "q" into the function Xf, the sustained pitch region detector 20 concludes the signal component c[i][q] to be effective. Accordingly, when the signal component c[i][q] is relatively large in comparison with the signal components in the upper-side and lower-side frequency bands near the present frequency band "q", the signal component c[i][q] is concluded to be effective. On the other hand, the signal component c[i][q] being effective does not always require the condition that the signal component c[i][q] is larger than each of the signal components in the upper-side and lower-side frequency bands near the present frequency band "q".

A first example of the function Xf is a "max" function which selects the maximum one among the parameters (arguments). In this case, the relations (13) are rewritten as follows.

$$c[i][q]>\max(c[i][q-G1],c[i][q-(G1+1)],\ldots,c[i][q-G2])$$

$$c[i][q]>\max(c[i][q+G1],c[i][q+(G1+1)],\ldots,c[i][q+G2]) \tag{14}$$

A second example of the function Xf is a "min" function which selects the minimum one among the parameters. A third example of the function Xf is an "average" function which calculates the average value of the parameters. A fourth example of the function Xf is a "median" function which selects a center value among the parameters. The second way utilizes the following facts. When a definite pitch instrument is played to generate a sound, the signal component in the frequency band corresponding to the generated sound is remarkably stronger than the signal components in the neighboring frequency bands. On the other hand, when a percussion instrument is played to generate a sound, the frequency spectrum of the generated sound widely spreads out so that the signal components in the center and neighboring frequency bands are similar in intensity or magnitude. Thus, the signal component c[i][q] counted as an effective one tends to be caused by playing a definite pitch instrument rather than a percussion instrument.

According to the third way, the sustained pitch region detector 20 decides whether or not the following relation (15) is satisfied.

$$c[i][q]>Xg(c[i-H][q+G2],c[i-H][q+G2-1],\ldots,c[i-H][q+G1],c[i-H][q-G1],$$

$$c[i-H][q-(G1+1)],\ldots,c[i-H][q-G2],\ldots,$$

$$c[i+H][q+G2],c[i+H][q+G2-1],\ldots,c[i+H][q+G1],c[i+H][q-G1],$$

$$c[i+H][q-(G1+1)],\ldots,c[i+H][q-G2]) \tag{15}$$

where Xg denotes a function taking Ng parameters or arguments. The integer Ng is given as follows.

$$Ng=2\cdot(2\cdot H+1)\cdot(G2-G1+1) \tag{16}$$

When the above relation (15) is satisfied, the sustained pitch region detector 20 concludes the signal component c[i][q] to be effective. Otherwise, the sustained pitch region detector 20 concludes the signal component c[i][q] to be not effective. In the above relations (15) and (16), G1 and G2 denote integers meeting conditions as 0<G1≦G2 while H denotes an integer equal to or larger than "0".

Figures 10, 11:
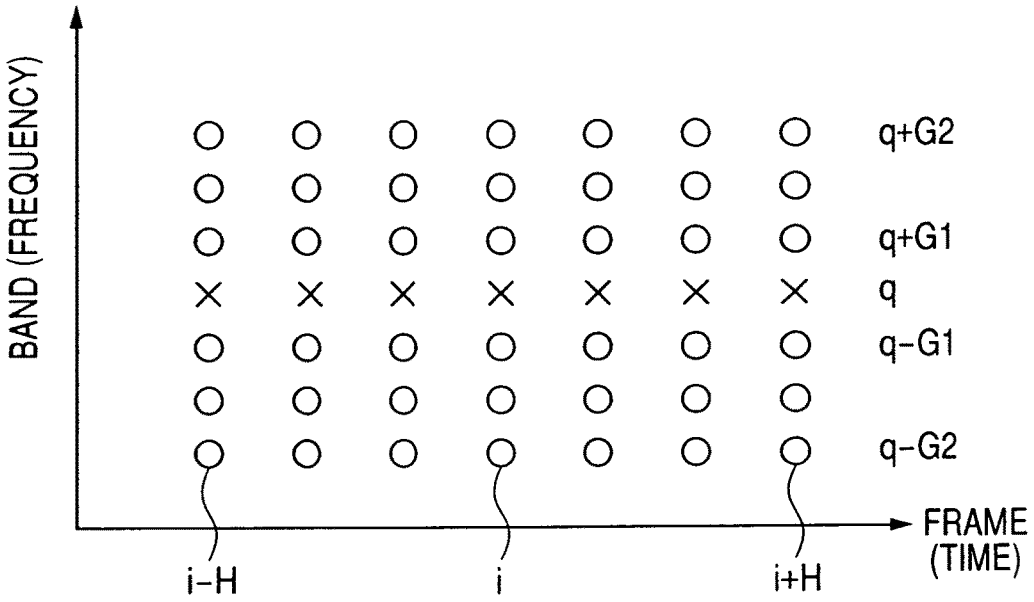
FIG. 10 is a diagram showing an example of the arrangement of a signal component of interest and neighboring signal components which include ones used for a check as to the effectiveness of the signal component of interest in the sustained pitch region detector in FIG. 2.
FIG. 11 is a diagram showing the format of data in a memory within a category classifier in FIG. 2.

FIG. 10 shows an example of the arrangement of the signal component c[i][q] and the neighboring signal components. In FIG. 10, the circles denote the signal components taken as the parameters (arguments) in the function Xg for the check as to the effectiveness of the signal component c[i][q] while the crosses denote the unused signal components. As shown in FIG. 10, selected ones among the signal components positionally neighboring the signal component c[i][q] are taken as the parameters. Not only selected signal components in the frame "i" but also those in the previous frames "i−1", "i−2", . . . and the later frames "i+1", "i+2", . . . are taken as the parameters. In the case where the frequency analyzer 12 tunes the frequency bands to the respective tones (semitones) in the musical scale, it is preferable to set each of the integers G1 and G2 to "1". When the signal component c[i][q] is relatively large in comparison with the neighboring signal components denoted by the circles in FIG. 10, the signal component c[i][q] is concluded to be effective. On the other hand, the signal component c[i][q] being effective does not always require the condition that the signal component c[i][q] is larger than each of the neighboring signal components.

A first example of the function Xg is a "max" function which selects the maximum one among the parameters. A second example of the function Xg is a "min" function which selects the minimum one among the parameters. A third example of the function Xg is an "average" function which calculates the average value of the parameters. A fourth example of the function Xg is a "median" function which selects a center value among the parameters. The third way utilizes the following facts. When a definite pitch instrument is played to generate a sound, the signal component in the frequency band corresponding to the generated sound is remarkably stronger than the signal components in the neighboring frequency bands. On the other hand, when a percussion instrument is played to generate a sound, the frequency spectrum of the generated sound widely spreads out so that the signal components in the center and neighboring frequency bands are similar in intensity or magnitude. Accordingly, the signal component c[i][q] counted as effective one tends to be caused by playing a definite pitch instrument rather than a percussion instrument.

According to the fourth way, the sustained pitch region detector 20 decides whether or not both the following relations (17) are satisfied.

$$c[i][h(d,q)]>Xh(c[i][h(d,q)-G3],c[i][h(d,q)-(G3+1)],\ldots,c[i][h(d,q)-G4])$$

$$c[i][h(d,q)]>Xh(c[i][h(d,q)+G3],c[i][h(d,q)+(G3+1)],\ldots,c[i][h(d,q)+G4]) \quad (17)$$

where Xh denotes a function taking (G4−G3+1) parameters or arguments, and G3 and G4 denote integers meeting conditions as 0<G3≦G4. In the case where the frequency analyzer 12 tunes the frequency bands to the respective tones (semitones) in the musical scale, it is preferable to set each of the integers G3 and G4 to "1". In the above relations (17), "d" denotes a natural number variable between "2" and D where D denotes a predetermined integer equal to "2" or larger. Further, h(d,q) denotes a function of returning a frequency-band ID number corresponding to a frequency equal to "d" times the center frequency of the band "q" (that is, a d-order overtone frequency). When both the above relations (17) are satisfied at all the natural numbers taken by "d", the sustained pitch region detector 20 concludes the signal component c[i][q] to be effective. Otherwise, the sustained pitch region detector 20 concludes the signal component c[i][q] to be not effective. Therefore, only in the case where the d-order overtone signal component c[i][h(d,q)] is larger than both the value resulting from substituting the i-th-frame signal components in the frequency bands "h(d,q)+G3, h(d,q)+(G3+1), . . . , h(d,q)+G4" higher in frequency than and near the present overtone frequency band "h(d,q)" into the function Xh and the value resulting from substituting the i-th-frame signal components in the frequency bands "h(d,q)−G3, h(d,q)−(G3+1), . . . , h(d,q)−G4" lower in frequency than and near the present overtone frequency band "h(d,q)" into the function Xh at all the natural numbers taken by "d", the sustained pitch region detector 20 concludes the signal component c[i][q] to be effective.

A first example of the function Xh is a "max" function which selects the maximum one among the parameters. A second example of the function Xh is a "min" function which selects the minimum one among the parameters. A third example of the function Xh is an "average" function which calculates the average value of the parameters. A fourth example of the function Xh is a "median" function which selects a center value among the parameters. The fourth way utilizes the following facts. When a definite pitch instrument is played to generate a tone, an overtone or overtones with respect to the generated tone are stronger than sounds having frequencies near the frequency of the generated tone. On the other hand, when a percussion instrument is played to generate a sound, overtone components of the generated sound are indistinct. Thus, the signal component c[i][q] counted as effective one tends to be caused by playing a definite pitch instrument rather than a percussion instrument.

According to the fifth way, the sustained pitch region detector 20 decides whether or not the following relation (18) is satisfied.

$$c[i][h(d,q)]>Xi(c[i-H][h(d,q)+G4],c[i-H][h(d,q)+G4-1],\ldots,$$
$$c[i-H][h(d,q)+G3],$$
$$c[i-H][h(d,q)-G3],c[i-H][h(d,q)-(G3+1)],\ldots,c[i-H][h(d,q)-G4],$$
$$c[i+H][h(d,q)+G4],c[i+H][h(d,q)+G4-1],\ldots,c[i+H][h(d,q)+G3],$$
$$c[i+H][h(d,q)-G3],c[i+H][h(d,q)-(G3+1)],\ldots,c[i+H][h(d,q)-G4]) \quad (18)$$

where Xi denotes a function taking Ni parameters or arguments. The integer Ni is given as follows.

$$Ni=2\cdot(2\cdot H+1)\cdot(G4-G3+1) \quad (19)$$

In the above relations (18) and (19), G3 and G4 denote integers meeting conditions as 0<G3≦G4 while H denotes an integer equal to or larger than "0". In the case where the frequency analyzer 12 tunes the frequency bands to the respective tones (semitones) in the musical scale, it is preferable to set each of the integers G3 and G4 to "1". In the above relation (18), "d" denotes a natural number variable between "2" and D where D denotes a predetermined integer equal to "2" or larger. Further, h(d,q) denotes a function of returning a frequency-band ID number corresponding to a frequency equal to "d" times the center frequency of the band "q" (that is, a d-order overtone frequency). When the above relation (18) is satisfied at all the natural numbers taken by "d", the sustained pitch region detector 20 concludes the signal component c[i][q] to be effective. Otherwise, the sustained pitch region detector 20 concludes the signal component c[i][q] to be not effective. Not only selected signal components in the frame "i" but also those in the previous and later frames are taken as the parameters.

A first example of the function Xi is a "max" function which selects the maximum one among the parameters. A second example of the function Xi is a "min" function which selects the minimum one among the parameters. A third example of the function Xi is an "average" function which calculates the average value of the parameters. A fourth example of the function Xi is a "median" function which selects a center value among the parameters. The fifth way utilizes the following facts. In general, a definite pitch instrument has a clear overtone structure while a percussion instrument does not. Thus, when a definite pitch instrument is played to generate a tone, an overtone or overtones with respect to the generated tone are stronger than sounds having frequencies near the frequency of the generated tone. On the other hand, when a percussion instrument is played to generate a sound, overtone components of the generated sound are indistinct. Thus, the signal component c[i][q] counted as effective one tends to be caused by playing a definite pitch instrument rather than a percussion instrument.

According to the sixth way, the sustained pitch region detector 20 decides whether or not all the following relations (20) are satisfied.

$$c[i][q]\geqq\alpha[q]$$

$$c[i][q]>Xf(c[i][q-G1],c[i][q-(G1+1)],\ldots,c[i][q-G2])$$

$$c[i][q]>Xf(c[i][q+G1],c[i][q+(G1+1)],\ldots,c[i][q+G2])$$

$$c[i][h(d,q)]>Xh(c[i][h(d,q)-G3],c[i][h(d,q)-(G3+1)],\ldots,c[i][h(d,q)-G4])$$

$$c[i][h(d,q)]>Xh(c[i][h(d,q)+G3],c[i][h(d,q)+(G3+1)],\ldots,c[i][h(d,q)+G4]) \quad (20)$$

When all the above relations (20) are satisfied, the sustained pitch region detector 20 concludes the signal component c[i][q] to be effective. Otherwise, the sustained pitch region detector 20 concludes the signal component c[i][q] to be not effective. The sixth way is a combination of the first, second, and fourth ways.

The seventh way is a combination of at least two of the first to sixth ways.

The feature quantity calculator 21 computes a vector Vf of Nf feature quantities (values) while referring to the sustained-pitch-region information in the memory 20*a*. As previously mentioned, the sustained-pitch-region information has pieces each representing a block ID number "p", a frequency-band ID number "q", and an effective signal component sum "s" as an indication of a related sustained pitch region (see FIG. 8). The feature quantity calculator 21 stores information representative of the computed feature quantity vector Vf into the memory 21*a*. Preferably, Nf=3, and the elements of the feature quantity vector Vf are denoted by Vf[0], Vf[1], and Vf[2] respectively. The feature quantity calculator 21 uses the total frame number M as a parameter representing the length of an interval for the analysis of an audio data segment. Alternatively, the feature quantity calculator 21 may use the number of seconds constituting the analysis interval or a value proportional to the lapse of time instead of the total frame number M.

The feature quantity calculator 21 accesses the memory 20*a*, and counts the sustained-pitch-region information pieces each corresponding to one sustained pitch region. The feature quantity calculator 21 computes the feature quantity Vf[0] according to the following equation.

$$Vf[0] = \frac{Ns}{M} \tag{21}$$

where Ns denotes the total number of the sustained-pitch-region information pieces. The computed feature quantity Vf[0] is larger for a music piece causing a higher degree of a sense of pitch strength. On the other hand, the computed feature quantity Vf[0] is smaller for a music piece causing a lower degree of a sense of pitch strength. In addition, the computed feature quantity Vf[0] is larger for a music piece with a greater thickness of sounds.

The feature quantity calculator 21 accesses the memory 20*a*, and computes a summation of the effective signal component sums "s" ($s_1, s_2, \ldots, s_j, \ldots, s_{Ns}$) each corresponding to one sustained pitch region. The feature quantity calculator 21 computes the feature quantity Vf[1] according to the following equation.

$$Vf[1] = \frac{\sum_{j=1}^{Ns} s_j}{M} \tag{22}$$

The computed feature quantity Vf[1] is larger for a music piece causing a higher degree of a sense of pitch strength. On the other hand, the computed feature quantity Vf[1] is smaller for a music piece causing a lower degree of a sense of pitch strength. In addition, the computed feature quantity Vf[1] is larger for a music piece with a greater thickness of sounds.

The feature quantity calculator 21 accesses the memory 20*a*, and counts different block ID numbers "p" each corresponding to one sustained pitch region. The feature quantity calculator 21 computes the feature quantity Vf[2] according to the following equation.

$$Vf[2] = \frac{Ns}{M \cdot Nu^a} \tag{23}$$

where Nu denotes the total number of the different block ID numbers "p", and "a" denotes a constant (predetermined value) meeting conditions as 0<a<1. The computed feature quantity Vf[2] is larger for a music piece causing a higher degree of a sense of pitch strength. On the other hand, the computed feature quantity Vf[2] is smaller for a music piece causing a lower degree of a sense of pitch strength. In addition, the computed feature quantity Vf[2] is larger for a music piece with a greater thickness of sounds.

The feature quantity calculator 21 stores information representative of the computed feature quantities Vf[0], Vf[1], and Vf[2] into the memory 21*a*. In other words, the feature quantity calculator 21 stores information representative of the computed feature quantity vector Vf into the memory 21*a*.

It should be noted that the feature quantity calculator 21 may compute a feature quantity from a variance or a standard deviation in the effective signal component sums "s" each corresponding to one sustained pitch region.

As previously mentioned, information (a signal) representing classification rules is previously stored in the memory 14*a*. The category classifier 14 refers to the feature quantities in the memory 21*a* and the classification rules in the memory 14*a*. According to the classification rules, the category classifier 14 classifies the music pieces into predetermined categories in response to the feature quantities. The category classifier 14 stores information pieces (signals) representative of the classification results into the memory 14*b*. The category classifier 14 arranges the stored classification-result information pieces (the stored classification-result signals) in a format such as shown in FIG. 11. In the memory 14*b*, the identifiers for the music pieces and the categories to which the music pieces belong are related with each other. The categories include music-piece genres such as "rock-and-roll", "classic", and "jazz". The categories may be defined by sensibility-related words or impression-related words such as "calm", "powerful", and "upbeat". The total number of the categories is denoted by Nc.

Figure 12:
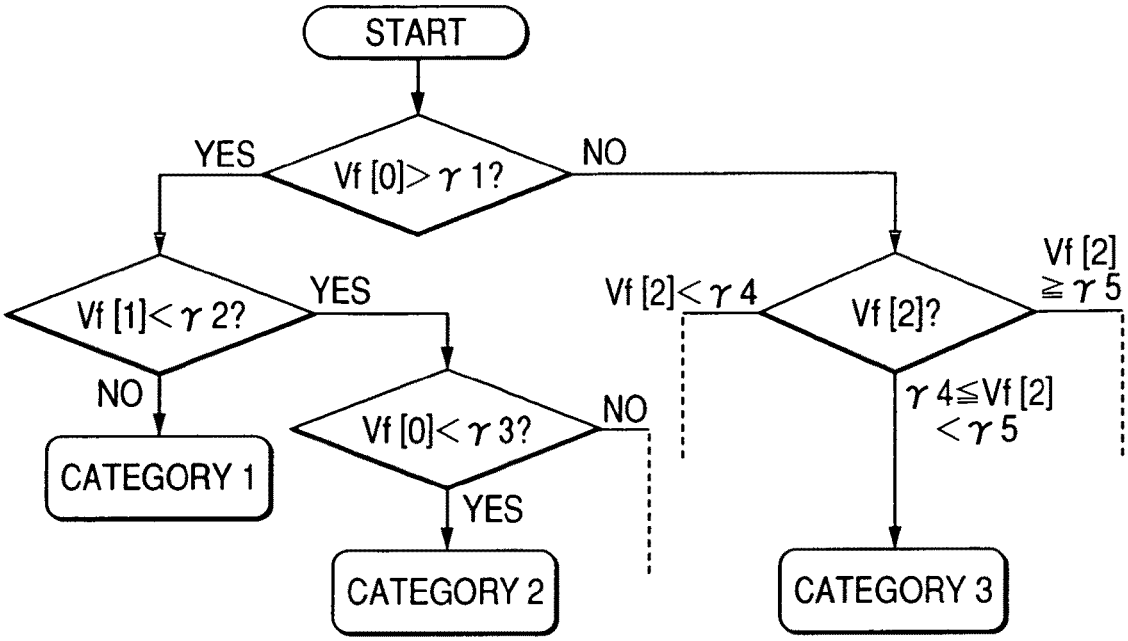
FIG. 12 is a flow diagram of an example of the structure of a decision tree used for classification rules in the category classifier in FIG. 2.

The classification rules use a decision tree, Bayes' rule, or an artificial neural network. In the case where the classification rules use a decision tree, the memory 14*a* stores information (a signal) representing a tree structure including conditions for relating the feature quantities Vf[0], Vf[1], and Vf[2] with the categories. FIG. 12 shows an example of the tree structure. The decision tree is made as follows. Music pieces for training are prepared. Feature quantities Vf[0], Vf[1], and Vf[2] are obtained for each of the music pieces for training. It should be noted that correct categories to which the music pieces for training belong are known in advance. According to a C4.5 algorithm, the decision tree is generated in response to sets each having the feature quantities Vf[0], Vf[1], and Vf[2], and the correct category.

In the case where the classification rules use Bayes' rule, the memory 14*a* stores information (a signal) representing parameters P(C[k]) and P(Vf|C[k]) where k=1, 2, . . . , Nc−1. Regarding a music piece having a feature quantity vector Vf, the category classifier 14 determines a category C[j] of the music piece according to the following equation.

$$C[j] = \arg\max_{k\in\{0,\ldots,Nc-1\}} P(C[k] \mid Vf) = \arg\max_{k\in\{0,\ldots,Nc-1\}} P(C[k])P(Vf \mid C[k]) \tag{24}$$

where P(C[k]|Vf) denotes a conditional probability that a category C[k] will occur when a feature vector Vf is obtained; P(Vf|C[k]) denotes a conditional probability that a feature vector Vf will be obtained, given the occurrence of a category C[k]; and P(C[k]) denotes a prior probability for the category C[k]. Accordingly, the category classifier 14 calculates the product of the parameters P(C[k]) and P(Vf|C[k]) for each of the categories. Then, the category identifier 14 selects the maximum one among the calculated products. Subsequently, the category identifier 14 identifies one among the categories which corresponds to the maximum product. The category identifier 14 stores information (a signal) representative of the identified category into the memory 14*b* as a classification result. The parameters P(C[k]) and P(Vf|C[k]) are predetermined as follows. Music pieces for training are prepared. The feature quantity vectors Vf are obtained for the music pieces for training, respectively. It should be noted that correct categories to which the music pieces for training belong are known in advance. The parameters P(C[k]) and P(Vf|C[k]) are precalculated by using sets each having the feature vector and the correct category.

Figure 13:
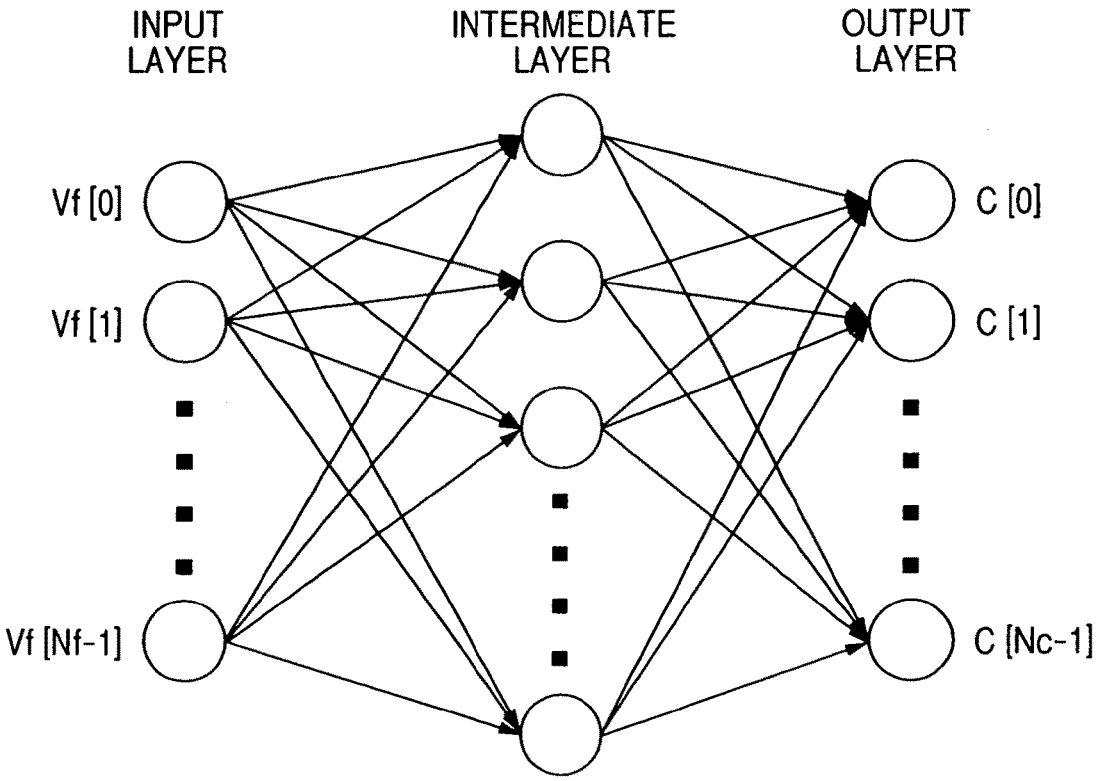
FIG. 13 is a diagram of an example of an artificial neural network used for the classification rules in the category classifier in FIG. 2.

The use of an artificial neural network for the classification rules will be explained hereafter. FIG. 13 shows an example of the artificial neural network. The memory 14*a* stores information (a signal) representing the artificial neural network. The category identifier 14 accesses the memory 14*a* to refer to the artificial neural network. With reference to FIG. 13, the artificial neural network is of a 3-layer type, and has an input layer of neurons, an intermediate layer of neurons, and an output layer of neurons. The number of the neurons in the input layer, the number of the neurons in the intermediate layer, and the number of the neurons in the output layer are equal to predetermined values, respectively. Each of the neurons in the intermediate layer is connected with all the neurons in the input layer and all the neurons in the output layer. The neurons in the input layer are designed to correspond to feature quantities Vf[0], Vf[1], . . . , Vf[Nf−1], respectively. The neurons in the output layer are designed to correspond to categories C[0], C[1], . . . , C[Nc−1], respectively.

Each of all the neurons in the artificial neural network responds to values inputted thereto. Specifically, the neuron multiplies the values inputted thereto with weights respectively, and sums the multiplication results. Then, the neuron subtracts a threshold value from the multiplication-results sum, and inputs the result of the subtraction into a neural network function. Finally, the neuron uses a value outputted from the neural network function as a neuron output value. An example of the neural network function is a sigmoid function. The artificial neural network is subjected to a training procedure before being actually used. Music pieces for training are prepared for the training procedure. The feature quantity vectors Vf are obtained for the music pieces for training, respectively. It should be noted that correct categories to which the music pieces for training belong are known in advance. During the training procedure, the feature quantity vectors Vf are sequentially and cyclically applied to the artificial neural network while output values from the artificial neural network are monitored and the weights and the threshold values of all the neurons are adjusted. The training procedure is continued until the output values from the artificial neural network become into agreement with the correct categories for the applied feature quantity vectors Vf. Thus, as a result of the training procedure, the weights and the threshold values of all the neurons are determined so that the artificial neural network is completed.

The category identifier 14 applies the feature quantities Vf[0], Vf[1], . . . , Vf[Nf−1] to the neurons in the input layer of the completed artificial neural network as input values respectively. Then, the category identifier 14 detects the maximum one among values outputted from the neurons in the output layer of the completed artificial neural network. Subsequently, the category identifier 14 detects an output-layer neuron outputting the detected maximum value. Thereafter, the category identifier 14 identifies one among the categories which corresponds to the detected output-layer neuron outputting the maximum value. The category identifier 14 stores information (a signal) representative of the identified category into the memory 14*b* as a classification result.

As understood from the above description, the music-piece classifying apparatus 1 detects, in a time frequency space defined by an audio data segment representing a music piece of interest, each place where a definite pitch instrument is played so that a signal component having a fixed frequency continues to stably occur in contrast to each place where a percussion instrument is played so that a signal component having a fixed frequency does not continue to stably occur. The music-piece classifying apparatus 1 obtains, from the detected places, feature quantities reflecting the degree of a sense of pitch strength concerning the music piece of interest. In addition, the music-piece classifying apparatus 1 counts signal components being caused by a definite pitch instrument or instruments and being stable in time and frequency. The music-piece classifying apparatus 1 obtains, from the total number of the counted signal components, a feature quantity reflecting the thickness of sounds concerning the music piece of interest. Thus, it is possible to accurately generate, from an audio data segment representing a music piece of interest, feature quantities reflecting the degree of a sense of pitch strength and the thickness of sounds. The music piece of interest is changed among a plurality of music pieces. The music-piece classifying apparatus 1 can accurately classify the music pieces according to category.

The music-piece classifying apparatus 1 automatically classifies the music pieces according to category while analyzing audio data segments representative of the music pieces. Basically, the music-piece classification does not require manual operation. The number of steps for the music-piece classification is relatively small.

The user can input information of a desired category into the music-piece classifying apparatus 1 by actuating the input device 10. The desired category is notified from the input device 10 to the CPU 3 via the input/output port 2. The CPU 3 accesses the RAM 5 or the storage unit 6 (the memory 14*b*) to search the classification results (see FIG. 11) for music-piece identifiers corresponding to the category same as the desired one. The CPU 3 sends the search-result identifiers to the display 40 via the input/output port 2, and enables the search-result identifiers to be indicated on the display 40. Thereby, information about music pieces belonging to the desired category is available to the user. It should be noted that the identifier for each music piece may include the title of the music piece and the name of the artist of the music piece.

The music-piece classifying apparatus 1 can be provided in a music player. In this case, the user can retrieve information about music pieces belonging to a desired category. Then, the user can select one among the music pieces before playing back the selected music piece. Accordingly, the user can find a desired music piece even when its title and artist are unknown at first.

Second Embodiment

A music-piece classifying apparatus in a second embodiment of this invention is similar to that in the first embodiment thereof except for design changes indicated hereafter.

In the music-piece classifying apparatus of the second embodiment of this invention, the details of the operation of the sustained pitch region detector 20 for a current music piece are as follows. Firstly, the sustained pitch region detector 20 sets a variable "p" to "0". The variable "p" indicates the ID number of a block to be currently processed, that is, a block of interest.

Secondly, the sustained pitch region detector 20 initializes the variable Rb to "0". The variable Rb indicates the thickness of sounds concerning the current block "p".

Thirdly, the sustained pitch region detector 20 sets the variable "q" to a constant (predetermined value) Q1 providing a lower limit from which a sustained pitch region can extend. The variable "q" indicates the ID number of a frequency band to be currently processed, that is, a frequency band of interest. The number Q1 is equal to or larger than "0" and smaller than the total frequency band number Q.

Fourthly, the sustained pitch region detector 20 sets the variable "i" to the value "p·Bs". The variable "i" indicates the ID number of a frame to be currently processed, that is, a frame of interest. Then, the sustained pitch region detector 20 sets variables "r" and "s" to "0". The variable "r" is used to count effective signal components. The variable "s" is used to indicate the sum of effective signal components.

Fifthly, the sustained pitch region detector 20 checks whether or not a signal component c[i][q] is effective as that in the first embodiment of this invention does. When the signal component c[i][q] is effective, the sustained pitch region detector 20 increments the effective signal component number "r" by "1" and updates the value "s" by adding the signal component c[i][q] thereto. When the signal component c[i][q] is not effective or when the updating of the value "s" is implemented, the sustained pitch region detector 20 increments the frame ID number "i" by "1".

Sixthly, the sustained pitch region detector 20 decides whether or not the frame ID number "i" is smaller than the value "(p+1)·Bs". When the frame ID number "i" is smaller than the value "(p+1)·Bs", the sustained pitch region detector 20 repeats the check as to whether or not the signal component c[i][q] is effective and the subsequent operation steps. On the other hand, when the frame ID number "i" is not smaller than the value "(p+1)·Bs", the sustained pitch region detector 20 compares the effective signal component number "r" with a constant (predetermined value) V equal to or less than the in-block total frame number Bs. This comparison is to decide whether or not there is a sustained pitch region defined by the effective signal components. When the effective signal component number "r" is equal to or larger than the constant V, it is decided that there is a sustained pitch region. On the other hand, when the effective signal component number "r" is less than the constant V, it is decided that there is no sustained pitch region.

In the case where the constant V is preset to the in-block total frame number Bs, a sustained pitch region is concluded to be present only when Bs effective signal components are successively detected. Generally, a note required to be generated for a certain time length tends to be accompanied with a vibrato (small frequency fluctuation). Such a vibrato causes effective signal components to be detected non-successively (intermittently) rather than successively. Accordingly, it is preferable to preset the constant V to a value between 80% of the in-block total frame number Bs and 90% thereof.

When the effective signal component number "r" is equal to or larger than the constant V or when it is decided that there is a sustained pitch region, the sustained pitch region detector 20 updates the sound thickness Rb of the current block "p" by adding the effective signal component sum "s" thereto (Rb←Rb+s). Subsequently, the sustained pitch region detector 20 increments the frequency-band ID number "q" by "1".

On the other hand, when the effective signal component number "r" is less than the constant V or when it is decided that there is no sustained pitch region, the sustained pitch region detector 20 immediately increments the frequency-band ID number "q" by "1".

After incrementing the frequency-band ID number "q" by "1", the sustained pitch region detector 20 compares the frequency-band ID number "q" with a constant (predetermined value) Q2 providing an upper limit to which a sustained pitch region can extend. The number Q2 is equal to or larger than the number Q1. The number Q2 is equal to or less than the total frequency band number Q. When the frequency-band ID number "q" is equal to or less than the constant Q2, the sustained pitch region detector 20 repeats setting the frame ID number "i" to the value "p·Bs" and the subsequent operation steps.

On the other hand, when the frequency-band ID number "q" is larger than the constant Q2, the sustained pitch region detector 20 stores, into the memory 20*a*, an information piece or a signal representing the sound thickness Rb of the current block "p". Preferably, the memory 20*a* has portions assigned to the different blocks respectively. The sustained pitch region detector 20 stores the information piece or the signal representative of the sound thickness Rb into the portion of the memory 20*a* which is assigned to the current block "p". Thereafter, the sustained pitch region detector 20 increments the block ID number "p" by "1".

Subsequently, the sustained pitch region detector 20 decides whether or not the block ID number "p" is less than the total block number Bn. When the block ID number "p" is less than the total block number Bn, the sustained pitch region detector 20 repeats initializing the sound thickness Rb to "0" and the subsequent operation steps. On the other hand, when the block ID number "p" is not less than the total block number Bn, the sustained pitch region detector 20 terminates the sustained pitch region detection for the current music piece.

As a result of the above-mentioned sustained pitch region detection, information pieces representing the sound thicknesses Rb of the respective blocks are stored in the memory 20*a*. The stored information pieces constitute sustained-pitch-region information. The sustained pitch region detector 20 arranges the stored information pieces in a format such as shown in FIG. 14.

Figure 15:
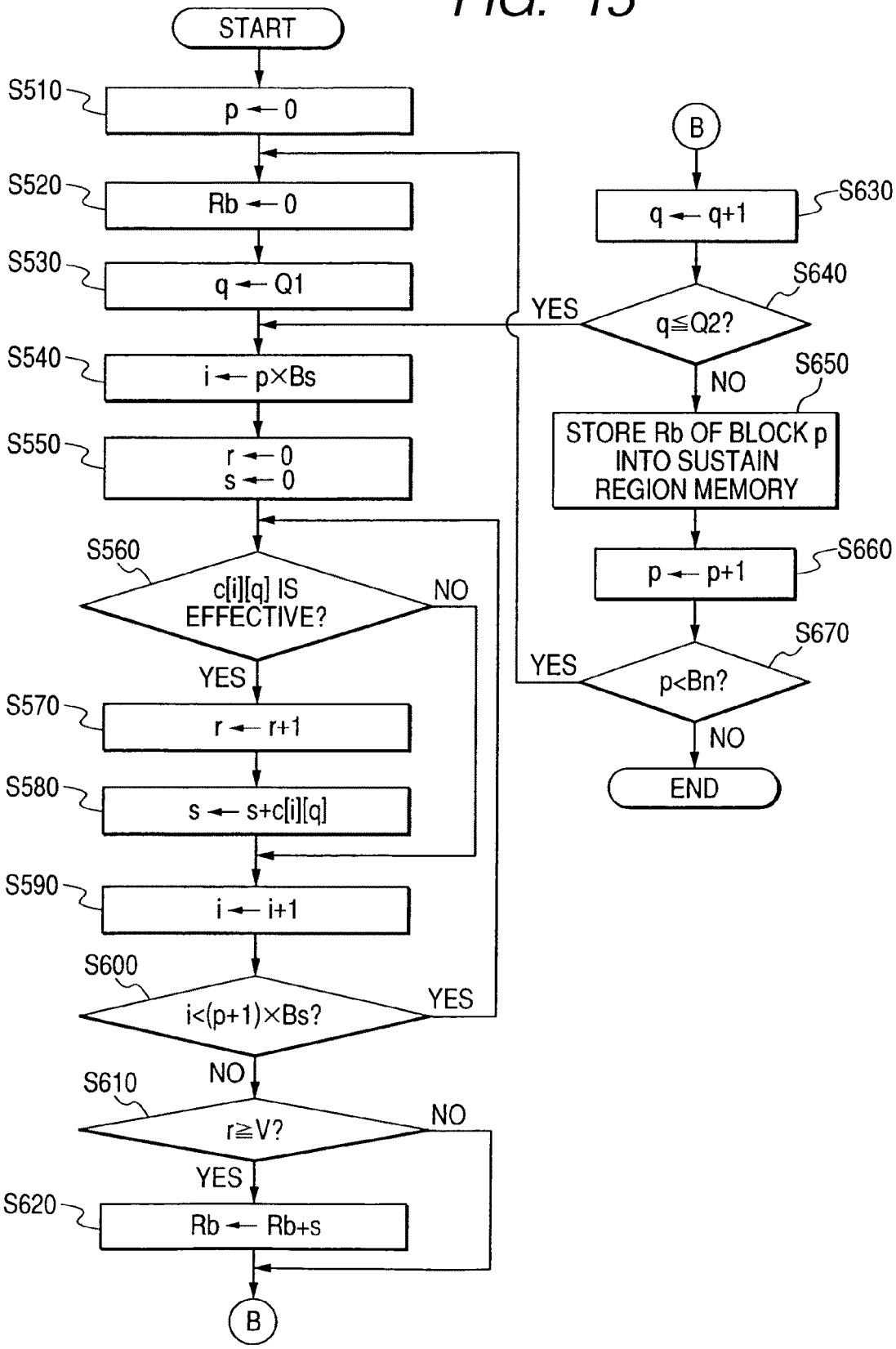
FIG. 15 is a flowchart of a segment of a control program for the music-piece classifying apparatus in the second embodiment of this invention which is designed to implement the sustained pitch region detector.

The control program for the music-piece classifying apparatus has a segment (subroutine) designed to implement the sustained pitch region detector 20. The program segment is executed for each audio data segment of interest, that is, each music piece of interest. FIG. 15 is a flowchart of the program segment.

As shown in FIG. 15, a first step S510 of the program segment sets the variable "p" to "0". The variable "p" indicates the ID number of a block to be currently processed, that is, a block of interest. After the step S510, the program advances to a step S520.

The step S520 initializes the variable Rb to "0". The variable Rb indicates the thickness of sounds concerning the current block "p".

A step S530 following the step S520 sets the variable "q" to the constant (predetermined value) Q1 providing the lower limit from which a sustained pitch region can extend. The variable "q" indicates the ID number of a frequency band to be currently processed, that is, a frequency band of interest. After the step S530, the program advances to a step S540.

The step S540 sets the variable "i" to the value "p·Bs", where Bs denotes the total number of frames constituting one block. The variable "i" indicates the ID number of a frame to be currently processed, that is, a frame of interest.

A step S550 subsequent to the step S540 sets the variables "r" and "s" to "0". The variable "r" is used to count effective signal components. The variable "s" is used to indicate the sum of effective signal components. After the step S550, the program advances to a step S560.

The step S560 checks whether or not the signal component c[i][q] is effective. When the signal component c[i][q] is effective, the program advances from the step S560 to a step S570. Otherwise, the program advances from the step S560 to a step S590.

The step S570 increments the effective signal component number "r" by "1". A step S580 following the step S570 updates the value "s" by adding the signal component c[i][q] thereto. After the step S580, the program advances to the step S590.

The step S590 increments the frame ID number "i" by "1". After the step S590, the program advances to a step S600.

The step S600 decides whether or not the frame ID number "i" is smaller than the value "(p+1)·Bs". When the frame ID number "i" is smaller than the value "(p+1)·Bs", the program returns from the step S600 to the step S560. Otherwise, the program advances from the step S600 to a step S610.

The step S610 compares the effective signal component number "r" with the constant (predetermined value) V equal to or less than the in-block total frame number Bs. This comparison is to decide whether or not there is a sustained pitch region defined by the effective signal components. When the effective signal component number "r" is equal to or larger than the constant V or when it is decided that there is a sustained pitch region, the program advances from the step S610 to a step S620. On the other hand, when the effective signal component number "r" is less than the constant V or when it is decided that there is no sustained pitch region, the program advances from the step S610 to a step S630.

The step S620 updates the sound thickness Rb of the current block "p" by adding the effective signal component sum "s" thereto (Rb←Rb+s). After the step S620, the program advances to the step S630.

The step S630 increments the frequency-band ID number "q" by "1". After the step S630, the program advances to a step S640.

The step S640 compares the frequency-band ID number "q" with the constant (predetermined value) Q2 providing the upper limit to which a sustained pitch region can extend. When the frequency-band ID number "q" is equal to or less than the constant Q2, the program returns from the step S640 to the step S540. On the other hand, when the frequency-band ID number "q" is larger than the constant Q2, the program advances from the step S640 to a step S650.

The step S650 stores, into the RAM 5 (the memory 20*a*), the information piece or the signal representing the sound thickness Rb of the current block "p". Preferably, the RAM 5 has portions assigned to the different blocks respectively. The step S650 stores the information piece or the signal representative of the sound thickness Rb into the portion of the RAM 5 which is assigned to the current block "p". The stored information piece or signal forms a part of sustained-pitch-region information.

A step S660 following the step S650 increments the block ID number "p" by "1". After the step S660, the program advances to a step S670.

The step S670 decides whether or not the block ID number "p" is less than the total block number Bn. When the block ID number "p" is less than the total block number Bn, the program returns from the step S670 to the step S520. Otherwise, the program exits from the step S670 and then the current execution cycle of the program segment ends.

The feature quantity calculator 21 computes a vector Vf of Nf feature quantities (values) while referring to the sustained-pitch-region information in the memory 20*a*. As previously mentioned, the sustained-pitch-region information represents the sound thicknesses Rb of the respective blocks (see FIG. 14). The feature quantity calculator 21 stores information representative of the computed feature quantity vector Vf into the memory 21*a*. Preferably, Nf=5, and the elements of the feature quantity vector Vf are denoted by Vf[0], Vf[1], Vf[2], Vf[3], and Vf[4] respectively. The feature quantity calculator 21 uses the total frame number M as a parameter representing the length of an interval for the analysis of an audio data segment. Alternatively, the feature quantity calculator 21 may use the number of seconds constituting the analysis interval or a value proportional to the lapse of time instead of the total frame number M.

The feature quantity calculator 21 accesses the memory 20*a* to get the sustained-pitch-region information representing the sound thicknesses Rb[i] (i=1, 2, . . . , Bn−1) of the respective blocks. The feature quantity calculator 21 computes the average value of the sound thicknesses Rb[i], and labels the computed average value as the feature quantity Vf[0] according to the following equation.

$$Vf[0] = \frac{\sum_{i=0}^{Bn-1} Rb[i]}{Bn} \tag{25}$$

where Bn denotes the total block number.

The feature quantity calculator 21 computes a variance or a standard deviation in the sound thicknesses Rb[i] from the average sound thickness Vf[0], and labels the computed variance as the feature quantity Vf[1] according to the following equation.

$$Vf[1] = \frac{\sum_{i=0}^{Bn-1} (Rb[i] - Vf[0])^2}{Bn} \tag{26}$$

The feature quantity calculator 21 computes a smoothness in a succession of the sound thicknesses Rb[i], and labels the computed smoothness as the feature quantity Vf[2] according to the following equation.

$$Vf[2] = \frac{\sum_{i=0}^{Bn-2} |Rb[i+1] - Rb[i]|}{Bn-1} \tag{27}$$

Specifically, the feature quantity calculator 21 computes the sum of the absolute values of the differences in sound thickness between the neighboring blocks. The feature quantity calculator 21 divides the computed sum by the value Bn-1, and labels the result of the division as the feature quantity Vf[2]. In the case where the thickness of sounds does not vary so much throughout the music piece of interest, the feature quantity Vf[2] is relatively small. On the other hand, in the case where the thickness of sounds varies so much, the feature quantity Vf[2] is relatively large.

Alternatively, the feature quantity calculator 21 may compute the feature quantity Vf[2] according to the following equation.

$$Vf[2] = \frac{\sum_{i=1}^{Bn-2} |2 \cdot Rb[i] - Rb[i-1] - Rb[i+1]|}{Bn-2} \quad (28)$$

Among the sound thicknesses Rb[i] (i=1, 2, . . . , Bn−1), the feature quantity calculator 21 counts ones equal to or larger than a prescribed value "α". The feature quantity calculator 21 divides the resultant count number Ba by the total block number Bn. The feature quantity calculator 21 sets the feature quantity Vf[3] to the result of the division. In the case where the thickness of sounds remains great throughout the music piece of interest, the feature quantity Vf[3] is relatively large. On the other hand, in the case where the thickness of sounds is appreciable for only a small part of the music piece of interest, the feature quantity Vf[3] is relatively small.

Among the sound thicknesses Rb[i] (i=β, β+1, . . . , Bn−1), the feature quantity calculator 21 counts ones each satisfying the following relation.

$$Rb[i-j] > Rb[i-j-1] (\forall j \epsilon \{0, \ldots, \beta-1\}) \quad (29)$$

where "β" denotes an integer equal to or larger than "1". The feature quantity calculator 21 divides the resultant count number Bc by the total block number Bn. The feature quantity calculator 21 sets the feature quantity Vf[4] to the result of the division. The above relation (29) holds when the sound thickness Rb[i] is monotonically increasing for (β+1) successive blocks. These conditions correlate with a hearing-related feeling of an uplift to some extent.

It should be noted that in the computation of the feature quantity Vf[4], the above-mentioned monotonic increase in the sound thickness Rb[i] may be replaced by one of (1) a monotonic decrease therein, (2) an increase therein which has a variation quantity equal to or larger than a prescribed value, (3) a monotonic increase therein which has a variation quantity equal to or larger than a prescribed value, (4) a decrease therein which has a variation quantity equal to or larger than a prescribed value, and (5) a monotonic decrease therein which has a variation quantity equal to or larger than a prescribed value.

The feature quantity calculator 21 stores information representative of the computed feature quantities Vf[0], Vf[1], Vf[2], Vf[3], and Vf[4] into the memory 21*a*. In other words, the feature quantity calculator 21 stores information representative of the computed feature quantity vector Vf into the memory 21*a*.

It should be noted that the feature quantities computed by the feature quantity calculator 21 may differ from the above-mentioned ones.

The music-piece classifying apparatus in the second embodiment of this invention more accurately extracts a feature quantity or quantities related to the thickness of sounds than that in the first embodiment of this invention does.

Usefulness of the Invention

This invention is useful for music-piece classification, music-piece retrieval, and music-piece selection in a music player having a recording medium storing a lot of music contents, music-contents management software running on a personal computer, or a distribution server in a music distribution service system.

What is claimed is:

1. A music-piece classifying apparatus comprising:

a processor;

first means including a frequency analyzer implemented by the processor for converting audio data related to at least a portion of a music piece into data components in respective different frequency bands for every unit time interval to generate time frequency data pieces assigned to the respective different frequency bands;

an effectiveness detector implemented by the processor for detecting, for each of the frequency bands, a data component satisfying a prescribed condition as an effective component for every unit time interval;

second means including a sustain region detector implemented by the processor for analyzing said time frequency data pieces generated by the first means and thereby deciding, for each of the frequency bands, whether or not at least a first prescribed number of effective components detected by the effectiveness detector are present in a reference time interval equal to said unit time interval multiplied by a second prescribed number, and detecting a sustain region corresponding to said frequency band in cases where it is decided that at least the first prescribed number of effective components detected by the effectiveness detector are present in said reference time interval;

third means including a feature quantity calculator implemented by the processor for calculating a feature quantity from at least one of (1) a number of the sustain regions detected by the second means and (2) magnitudes of values calculated from the data components in the sustain regions; and fourth means including a classifier device implemented by the processor for classifying the music piece in response to the feature quantity calculated by the third means.

2. A music-piece classifying apparatus as recited in claim 1, wherein the third means comprises means for calculating the feature quantity from at least one of (1) an average of the magnitudes of the values calculated from the data components in the sustain regions, (2) a variance or a standard deviation in the magnitudes of the values calculated from the data components in the sustain regions, (3) differences between the magnitudes of the values calculated from the data components in the sustain regions, (4) a number of ones among the data components in the sustain regions, said ones having values equal to or larger than a prescribed value, and (5) a number of ones among the data components in the sustain regions which have a prescribed variation pattern.

3. A music-piece classifying apparatus as recited in claim 1, wherein the third means comprises means for dividing the number of the sustain regions by the length of the time frequency data pieces analyzed by the sustain region detector for detection of said sustain regions to obtain a first division-result value, means for dividing the addition value of the intensities of the data components in the sustain regions by the length of the time frequency data pieces analyzed by the sustain region detector for detection of said sustain regions to obtain a second division-result value, and means for calculating the feature quantity from the obtained first division-result value or the obtained second division-result value.

4. A music-piece classifying apparatus as recited in claim 1, wherein the first prescribed number is smaller than the second prescribed number.

5. A music-piece classifying apparatus as recited in claim 1, wherein the prescribed condition is that the intensity of the data component is equal to or greater than a prescribed value.

6. A music-piece classifying apparatus as recited in claim 5, wherein the effectiveness detector comprises means for adding the intensities of the data components to be subjected to the detection of the effective components into an addition-result value in the time base direction, and means for calculating the prescribed value through the use of the addition-result value.

7. A music-piece classifying apparatus as recited in claim 1, wherein the effectiveness detector comprises means for specifying other data components which are at time equal to or near the time of the data components to be subjected to the detection of the effective components, and which correspond to frequency bands near the frequency band of the data components to be subjected to the detection of the effective components as neighboring components, and means for calculating the intensities of the neighboring components, and wherein the prescribed condition is that the intensities of the data components to be subjected to the detection of the effective components are greater than values calculated from the intensities of the neighboring components.

8. A music-piece classifying apparatus as recited in claim 1, wherein the effectiveness detector comprises means for specifying other data components which are at time equal to the time of the data components to be subjected to the detection of the effective components, and which correspond to a frequency band in an overtone frequency relation with the frequency band of the data components to be subjected to the detection of the effective components as overtone components, means for specifying other data components which are at time equal to or near the time of the overtone components, and which correspond to frequency bands near the frequency band of the overtone components as neighboring components, and means for calculating the intensities of the neighboring components, and wherein the prescribed condition is that the intensities of the overtone components are greater than values calculated from the intensities of the neighboring components.

9. A music-piece classifying apparatus as recited in claim 1, wherein the frequency bands comprise at least one of (1) frequency bands spaced at equal intervals in frequency domain, (2) frequency bands corresponding to the frequencies of tones constituting the musical scale respectively, and (3) frequency bands resulting from more finely dividing the semitone frequency intervals in the equal tempered scale.

10. A music-piece classifying apparatus as recited in claim 1, wherein the third means calculates the feature quantity from the number of the sustain regions detected by the second means.

11. A music-piece classifying method comprising the steps of:

inputting via an input device audio data related to at least a portion of a music piece;

using a processor to form a frequency analyzer and thereby converting the audio data into data components in respective different frequency bands for every unit time interval to generate time frequency data pieces assigned to the respective different frequency bands;

using the processor to form an effectiveness detector and thereby detecting, for each of the frequency bands, a data component satisfying a prescribed condition as an effective component for every unit time interval;

using the processor to form a sustain region detector and thereby analyzing said time frequency data pieces and deciding, for each of the frequency bands, whether or not at least a first prescribed number of detected effective components are present in a reference time interval equal to said unit time interval multiplied by a second prescribed number, and detecting a sustain region corresponding to said frequency band in cases where it is decided that at least the first prescribed number of detected effective components are present in said reference time interval;

using the processor to form a feature quantity calculator and thereby calculating a feature quantity from at least one of (1) a number of the detected sustain regions and (2) magnitudes of values calculated from the data components in the detected sustain regions; and using the processor to form a classifier device and thereby classifying the music piece in response to the calculated feature quantity.

12. A music-piece classifying method as recited in claim 11, wherein the feature quantity calculation comprises calculating the feature quantity from at least one of (1) an average of the magnitudes of the values calculated from the data components in the sustain regions, (2) a variance or a standard deviation in the magnitudes of the values calculated from the data components in the sustain regions, (3) differences between the magnitudes of the values calculated from the data components in the sustain regions, (4) a number of ones among the data components in the sustain regions, said ones having values equal to or larger than a prescribed value, and (5) a number of ones among the data components in the sustain regions which have a prescribed variation pattern.

13. A music-piece classifying method as recited in claim 11, wherein the first prescribed number is smaller than the second prescribed number.

14. A music-piece classifying method as recited in claim 11, wherein the feature quantity is calculated from the number of the detected sustain regions.

15. A computer program product stored in a non-transitory computer-readable medium, comprising the steps of:

using a frequency analyzer and thereby converting audio data related to at least a portion of a music piece into data components in respective different frequency bands for every unit time interval to generate time frequency data pieces assigned to the respective different frequency bands;

using an effectiveness detector and thereby detecting, for each of the frequency bands, a data component satisfying a prescribed condition as an effective component for every unit time interval;

using a sustain region detector and thereby analyzing said time frequency data pieces and deciding, for each of the frequency bands, whether or not at least a first prescribed number of detected effective components are present in a reference time interval equal to said unit time interval multiplied by a second prescribed number, and detecting a sustain region corresponding to said frequency band in cases where it is decided that at least the first prescribed number of detected effective components are present in said reference time interval;

using a feature quantity calculator and thereby calculating a feature quantity from at least one of (1) a number of the detected sustain regions and (2) magnitudes of values calculated from the data components in the detected sustain regions; and using a classifier device and thereby classifying the music piece in response to the calculated feature quantity.

16. A computer program product as recited in claim 15, wherein the feature quantity calculation comprises calculating the feature quantity from at least one of (1) an average of the magnitudes of the values calculated from the data components in the sustain regions, (2) a variance or a standard deviation in the magnitudes of the values calculated from the data components in the sustain regions, (3) differences between the magnitudes of the values calculated from the data components in the sustain regions, (4) a number of ones among the data components in the sustain regions, said ones having values equal to or larger than a prescribed value, and (5) a number of ones among the data components in the sustain regions which have a prescribed variation pattern.

17. A computer program product as recited in claim 15, wherein the first prescribed number is smaller than the second prescribed number.

18. A computer program product as recited in claim 15, wherein the feature quantity is calculated from the number of the detected sustain regions.

19. A music-piece classifying apparatus comprising:

a processor;

first means including a frequency analyzer implemented by the processor for converting audio data representative of a music piece into data components in respective different frequency bands for every unit time interval;

second means for deciding whether or not each of the data components in the respective different frequency bands is effective;

third means for detecting, in a time frequency space defined by the different frequency bands and lapse of time, each sustain region where a data component in only one of the different frequency bands which is decided to be effective by the second means continues to occur during a reference time interval or longer, wherein said detected sustain region corresponds to said one of the different frequency bands only, and for implementing said detecting each sustain region on a frequency-band by frequency-band basis;

fourth means including a feature quantity calculator implemented by the processor for counting sustain regions detected by the third means to compute the total number of said sustain regions and for calculating a feature quantity from the computed total number; and fifth means for classifying the music piece in response to the feature quantity calculated by the fourth means.

* * * * *